US012270227B2

(12) United States Patent
Abela

(10) Patent No.: US 12,270,227 B2
(45) **Date of Patent: *Apr. 8, 2025**

(54) DUCTILE ANCHOR ATTACHMENT (DAA) MECHANISM, FUSE PLATE SYSTEM, AND MODIFIED JACKET

(71) Applicant: Christopher Abela, Veazie, ME (US)

(72) Inventor: Christopher Abela, Veazie, ME (US)

( * ) Notice: Subject to any disclaimer, the term of this patent is extended or adjusted under 35 U.S.C. 154(b) by 247 days.

This patent is subject to a terminal disclaimer.

(21) Appl. No.: 17/973,107

(22) Filed: Oct. 25, 2022

(65) Prior Publication Data

US 2023/0110886 A1 Apr. 13, 2023

Related U.S. Application Data

(63) Continuation-in-part of application No. 16/922,849, filed on Jul. 7, 2020, now Pat. No. 11,499,331.

(60) Provisional application No. 62/906,337, filed on Sep. 26, 2019.

(51) Int. Cl.

| | |
|---|---|
| ***E04H 9/02*** | (2006.01) |
| ***E04B 1/24*** | (2006.01) |
| ***E04B 1/38*** | (2006.01) |

(52) U.S. Cl.

CPC ..... *E04H 9/021* (2013.01); *E04B 1/2403* (2013.01); *E04B 1/388* (2023.08); *E04B 2001/2415* (2013.01); *E04B 2001/2418* (2013.01); *E04B 2001/2442* (2013.01); *E04B 2001/2451* (2013.01); *E04B 2001/2463* (2013.01)

(58) Field of Classification Search

CPC ..... E04H 9/021; E04H 9/0215; E04H 9/0235; E04H 9/0237

See application file for complete search history.

(56) References Cited

U.S. PATENT DOCUMENTS

| | | | |
|---|---|---|---|
| 5,256,016 | A | 10/1993 | Godfrey |
| 8,375,652 | B2 | 2/2013 | Hiriyur |
| 10,370,844 | B2 | 8/2019 | Lomax |
| 2003/0222188 | A1 | 12/2003 | Smelser |
| 2005/0005539 | A1 | 1/2005 | Nakamura |
| 2005/0257490 | A1 | 11/2005 | Pryor |
| 2006/0101733 | A1 | 5/2006 | Jen |
| 2013/0074440 | A1 | 3/2013 | Black |

(Continued)

FOREIGN PATENT DOCUMENTS

| | | | |
|---|---|---|---|
| CN | 107386479 | A | 11/2017 |
| WO | WO-9905364 | A1 | 2/1999 |

(Continued)

*Primary Examiner* — Babajide A Demuren

(74) *Attorney, Agent, or Firm* — Heisler & Associates

(57) ABSTRACT

A ductile anchor attachment (DAA) mechanism is disclosed. Example embodiments are directed to a DAA fuse plate including a bottom section configured to connect to an existing anchor; a tapered lower section; a narrowed neck forming a ductile yield mechanism; a tapered upper section; and a connection mechanism for direct removable coupling of the DAA fuse plate to a structure being anchored, the connection mechanism being in contact with the tapered upper section of the DAA fuse plate, the DAA fuse plate in combination with the connection mechanism being configured to not buckle under compression forces and to adjustably dissipate tension forces acting on the structure being anchored.

20 Claims, 38 Drawing Sheets

(56) References Cited

U.S. PATENT DOCUMENTS

| | | | |
|---|---|---|---|
| 2014/0311059 | A1 | 10/2014 | Pryor |
| 2021/0095491 | A1 | 4/2021 | Abela |

FOREIGN PATENT DOCUMENTS

| | | | | | |
|---|---|---|---|---|---|
| WO | WO-0008259 | A1 * | 2/2000 | ..... | E01D 19/103 |
| WO | WO-2012119763 | A1 | 9/2012 | | |

* cited by examiner

DUCTILE ANCHOR
ATTACHMENT
CAPACITY < 5 KIPS

DAA

PIPE STOCK

USE/PROCESS:
1. DAA IS ATTACHED TO THE ENDS OF ANCHOR HEADS IN A POST-TENSION TRUNNION GIRDER.
2. IF AN ANCHOR FAILS THE ANCHOR WILL IMPACT THE SCREW CAP OF THE DAA.
3. FOLLOWING IMPACT, THE THIN WALL SECTION WILL YIELD WITHOUT DAMAGING THE BOTTOM THREADS.
4. FOLLOWING INCIDENT THE DAA AND ANCHOR ARE REPLACED.

DAA ASSEMBLY COMPONENTS

Replacement Sheet

DAA ASSEMBLY COMPONENTS

MOMENT FRAME WITH DAA INSTALLED

DUCTILE ANCHOR ATTACHMENT (DAA) MECHANISM, FUSE PLATE SYSTEM, AND MODIFIED JACKET

PRIORITY PATENT APPLICATIONS

This non-provisional continuation-in-part (CIP) patent application draws priority from U.S. non-provisional patent application Ser. No. 16/922,849, filed Jul. 7, 2020, which is a non-provisional patent application drawing priority from U.S. provisional patent application Ser. No. 62/906,337; filed Sep. 26, 2019. This present CIP patent application draws priority from the referenced patent applications. The entire disclosure of the referenced patent applications is considered part of the disclosure of the present application and is hereby incorporated by reference herein in its entirety.

COPYRIGHT

A portion of the disclosure of this patent document contains material that is subject to copyright protection. The copyright owner has no objection to the facsimile reproduction of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2018-2022 Christopher ABELA, All Rights Reserved.

TECHNICAL FIELD

This patent application relates to structural anchors subjected to seismic or lateral forces according to one embodiment, and more specifically to a ductile anchor attachment (DAA) that can provide a stable controlled ductile yield mechanism to dissipate tension forces, and in certain embodiments compression forces, during a seismic or lateral force event while preserving the threads that connect the DAA to an existing anchor.

BACKGROUND

There have long been anchoring devices for securing beams to concrete structural members, and alternatively to perpendicular beams. The concrete anchors have often been large bolts, each inserted straight or bent at a right angle and placed in concrete prior to curing. These bolts are typically heavy and expensive, and concentrate the anchoring load on a single line. Seismic or lateral forces can transfer energy to these anchoring devices and cause rapid, catastrophic, and expensive brittle failures.

According to American Concrete Institute (ACI) building code requirements (ACI 318-14), anchors assigned to certain seismic design categories must satisfy certain requirements, one of which is to develop a ductile yield mechanism. Conventional anchoring devices cannot provide a ductile yield mechanism.

BRIEF DESCRIPTION OF THE DRAWINGS

The various embodiments are illustrated by way of example, and not by way of limitation, in the figures of the accompanying drawings in which.

DETAILED DESCRIPTION

In the following description, for purposes of explanation, numerous specific details are set forth in order to provide a thorough understanding of the various embodiments. It will be evident, however, to one of ordinary skill in the art that the various embodiments may be practiced without these specific details.

In various example embodiments described herein, a ductile anchor attachment (DAA) mechanism is disclosed. Example embodiments are directed to a DAA mechanism, which can attach to a post installed anchor, and is designed to develop and provide a ductile yield mechanism, thus making the example embodiments ideal for either new or existing post installed anchors. The following excerpt from American Concrete Institute (ACI) 318-14 is the specific codified requirement to which the example embodiments are directed: "Ch. 17 Section 17.2.3.4.3b "(b) The anchor or group of anchors shall be designed for the maximum tension that can be transmitted to the anchor or group of anchors based on the development of a ductile yield mechanism in the attachment in tension, flexure, shear, or bearing, or a combination of those conditions, and considering both material over-strength and strain hardening effects for the attachment." The DAA system as disclosed herein is designed to meet current building code guidance related to ACI 318-14 Section 17.2.3.4.3b and Section 17.2.3.4.3d. The DAA system as disclosed herein is also designed to meet American Institute of Steel Construction (AISC) Seismic Design Manual 341-10 Chapter D. Section D.2.6c: Where column/supporting member bases are designed as moment connections to the foundation, the required flexural strength of column/supporting member bases that are designated as part of the SFRS, including their attachment to the foundation, shall be the summation of the required connection strength of the steel elements that are connected to the column/supporting member base as follows:

b) For columns/supporting members, the required flexural strength shall be at least equal to the lesser of the following:

i. 1.1*Ry*Fy*Z (LRFD) or (1.1/1.5)*Ry*Fy*Z (ASD), as applicable, of the column/supporting member, or ii. the moment calculated using the load combinations of the applicable building code, including the amplified seismic load.

The various example embodiments disclosed herein are designed to enable a stable controlled ductile yield mechanism to form within the DAA mechanism to dissipate tension forces during a seismic or lateral force event while preserving the threads that connect the DAA mechanism to the existing anchor. This allows the DAA mechanism to be conveniently and inexpensively removed and replaced following a seismic or lateral force event or other event producing significant tension forces.

Figure 1:
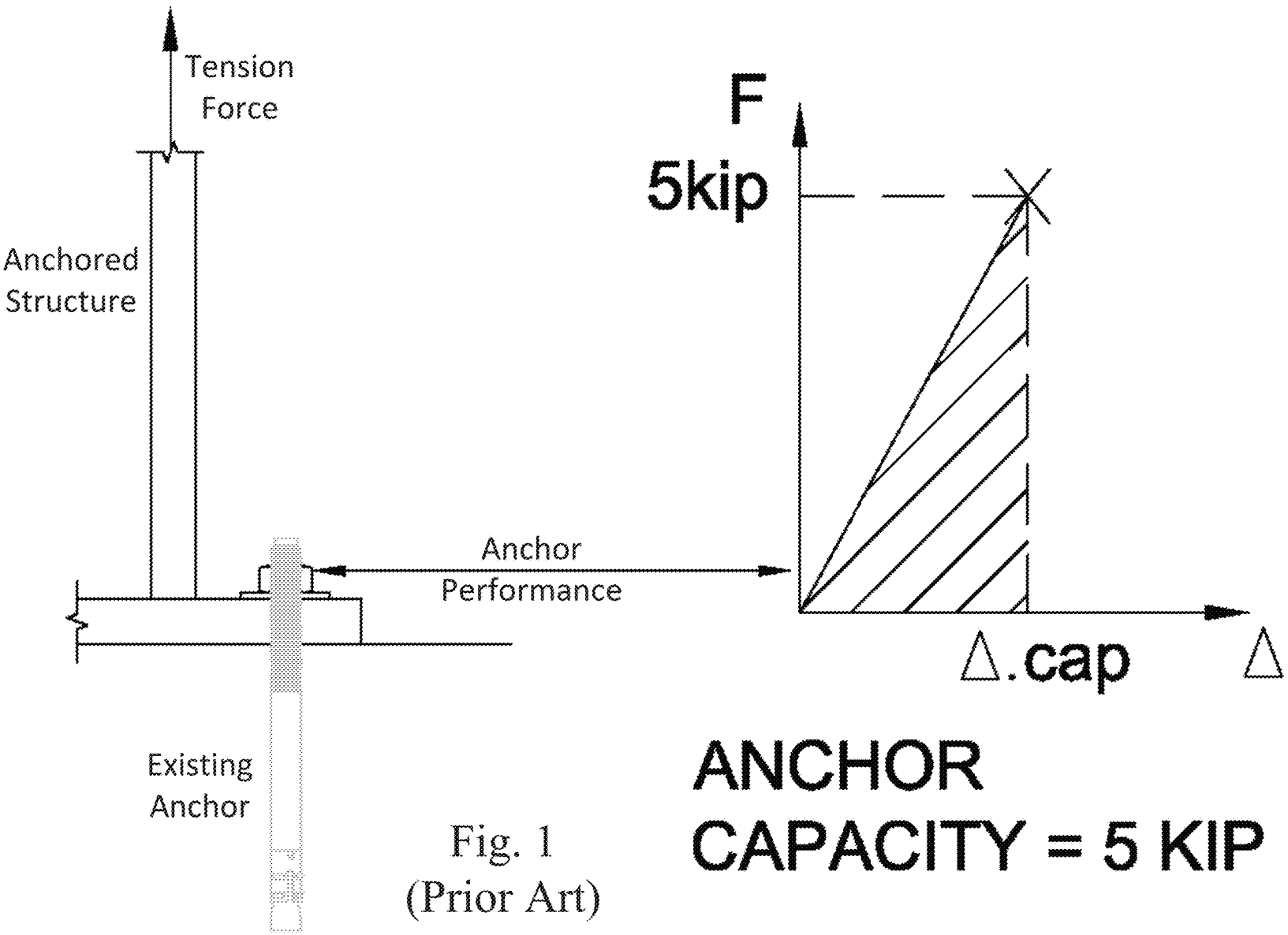
Fig. 1 (Prior Art)
FIG. 1 illustrates a conventional anchor without a ductile yield mechanism showing idealized force deflection performance of the conventional post-installed anchor.

FIG. 1 illustrates a conventional anchor without a ductile yield mechanism showing idealized force deflection performance of the conventional post-installed anchor. The area under the curve shown in FIG. 1 represents work capacity of the system in terms of Joules. Note the linear performance of the conventional anchor without a ductile yield mechanism and assumed brittle failure mode.

Figure 2:
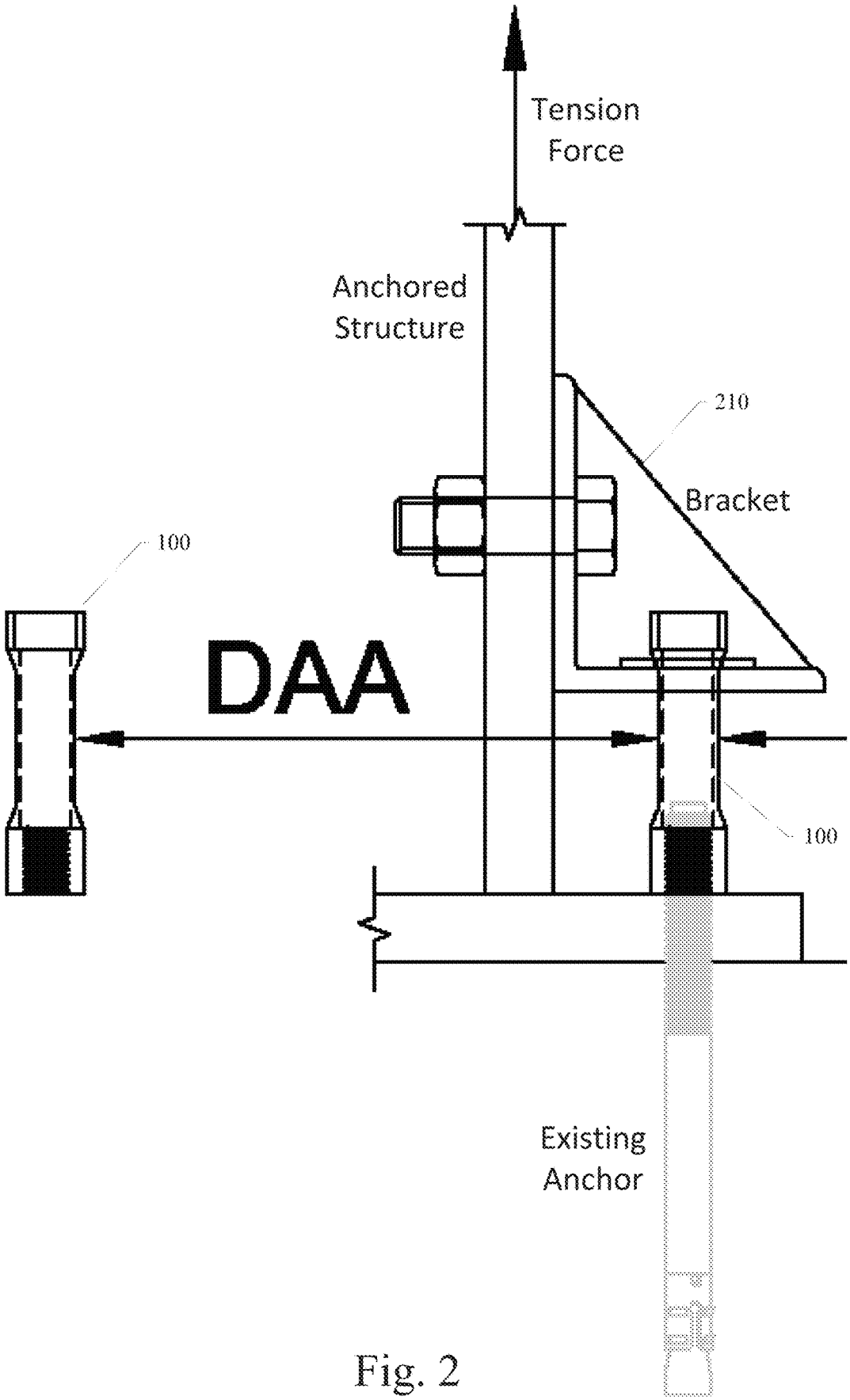
FIG. 2 illustrates an example embodiment of a ductile anchor attachment (DAA) mechanism attached to an anchored structure.

FIG. 2 illustrates an example embodiment of a DAA mechanism 100, the structure and fabrication of which is described in more detail below.

Figure 3:
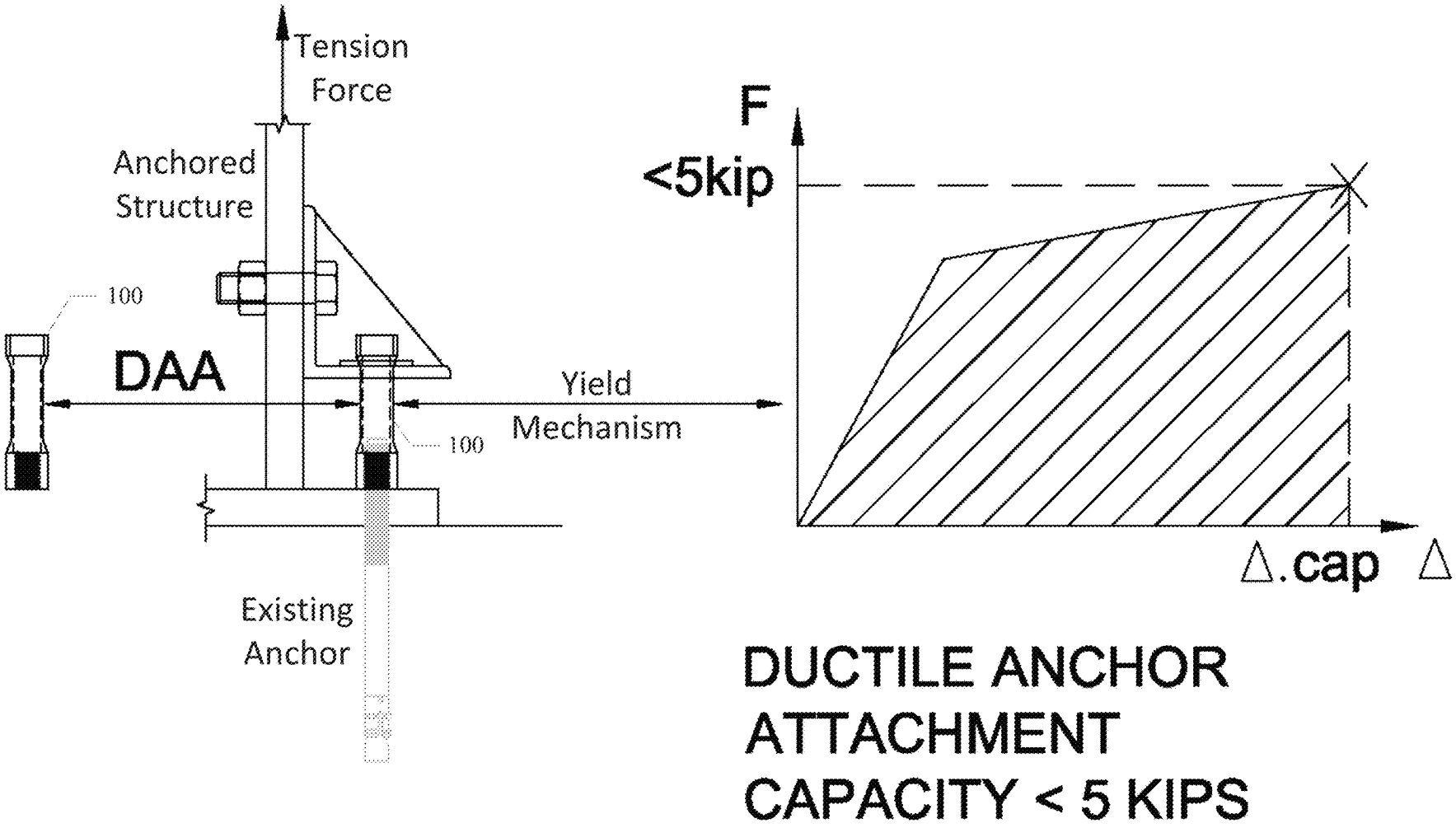
FIG. 3 illustrates an example embodiment of the DAA mechanism showing idealized force deflection performance of the post-installed DAA mechanism.

FIG. 3 illustrates an example embodiment of the DAA mechanism showing idealized force deflection performance of the post-installed DAA mechanism. The area under the curve shown in FIG. 3 represents work capacity of the system in terms of Joules. The DAA system as disclosed herein works; because, the DAA mechanism can deflect forces more extensively than the existing anchorage system. This allows the DAA mechanism to deform under a lower tension force than the existing anchor's capacity, thereby allowing the seismic (or other force-producing) event to be dissipated by the DAA mechanism without overloading the anchor.

Currently, conventional anchorage systems do not provide a ductile yield mechanism. One advantage of the DAA mechanism as disclosed herein is that the DAA mechanism can decrease the embedment depth of expansion anchors that must adhere to other codified requirements if a ductile attachment is not employed. In addition, the DAA mechanism is customizable to suit the needs of an existing or new anchorage system. For example, the neck of the DAA mechanism can be designed or calibrated to dissipate forces of the seismic or lateral force event at a pre-defined level while taking into consideration the capacity of the existing anchor.

Figure 5:
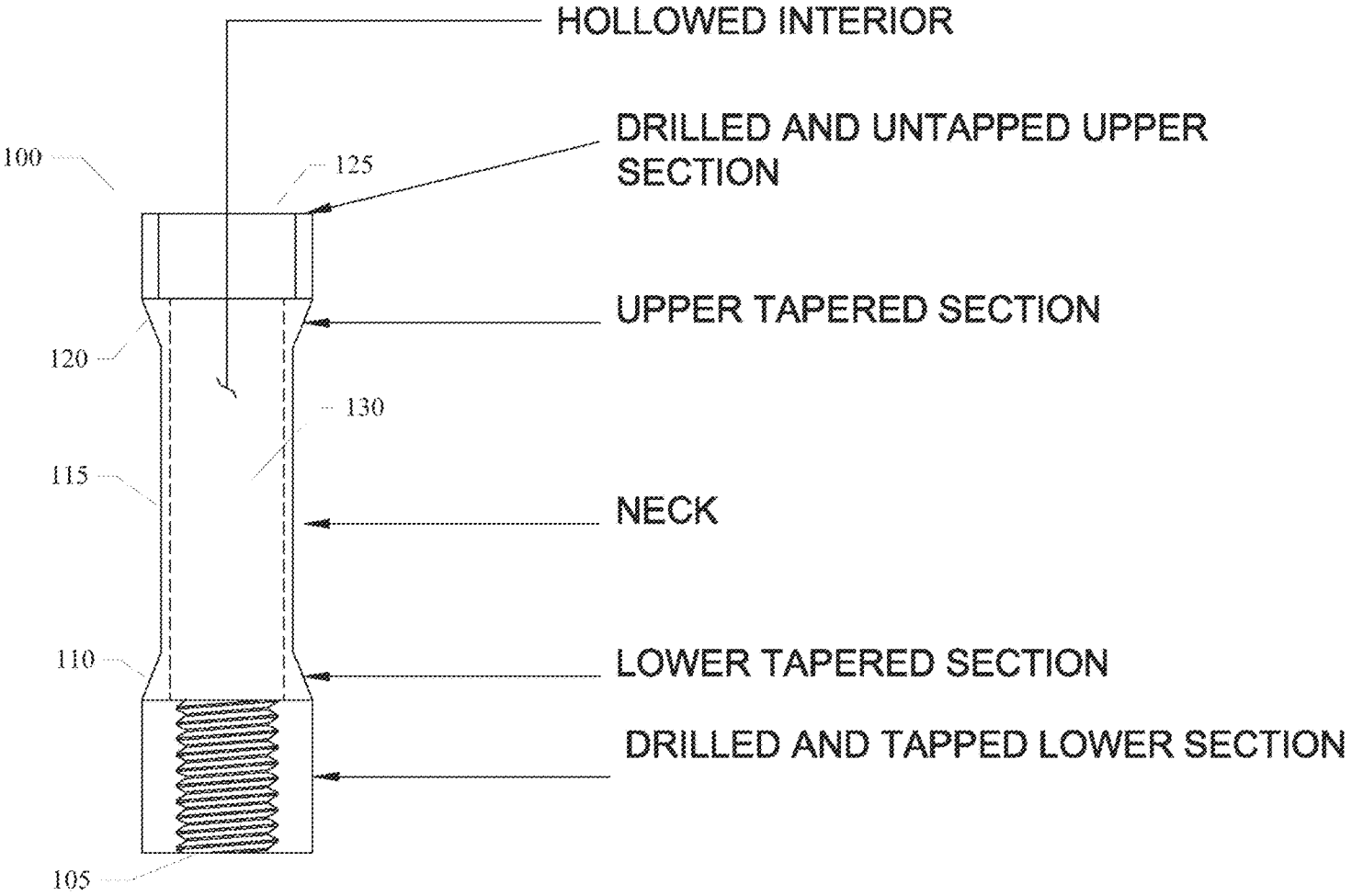
FIGS. 4 and 5 illustrate the components and fabrication of a DAA mechanism according to example embodiments.
Figure 4:
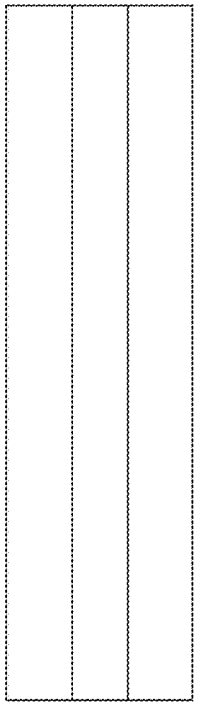

FIGS. 4 and 5 illustrate the components and fabrication of a DAA mechanism 100 according to example embodiments. In the DAA mechanism 100 according to an example embodiment shown in FIG. 5, the DAA mechanism 100 can include a drilled and tapped (threaded) bottom section 105 to allow the DAA mechanism 100 to connect to an existing anchor; a tapered lower section 110 to prevent the yield mechanism from forming near the threads of the bottom section 105; a narrowed neck 115 to allow the DAA mechanism 100 to form a configurable ductile yield mechanism; a tapered upper section 120 to prevent the yield mechanism from forming near the top section; a drilled and untapped (unthreaded) top section 125 to allow the DAA mechanism 100 to be engaged and pulled; and a hollowed interior 130 to allow for the DAA mechanism 100 to screw down into the supporting base regardless of anchor height. As shown in FIG. 4, an example embodiment of the DAA mechanism 100 can be fabricated from conventional pipe stock.

Referring again to FIG. 2, the diagram illustrates an example embodiment of a DAA mechanism 100 of an example embodiment attached to an anchored structure.

Figure 6:
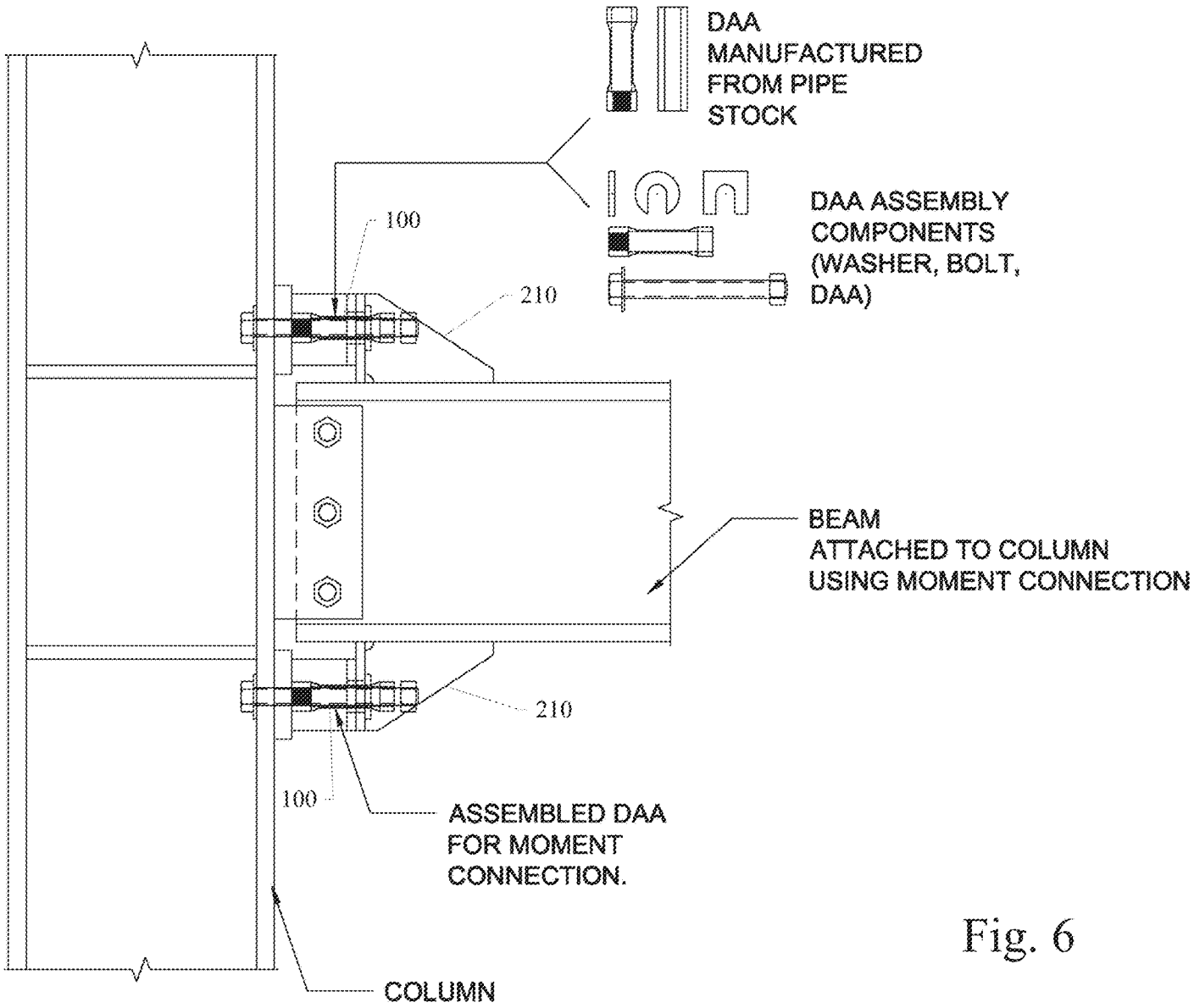
FIG. 6 illustrates an example embodiment of a DAA mechanism attached to an anchored structure.

FIG. 6 illustrates another example embodiment of a DAA mechanism 100 attached to an anchored structure. FIGS. 2 and 6 illustrate the DAA mechanism 100 installed in a concrete anchorage system using a bracket 210 that connects the DAA mechanism 100 to the structure being anchored or a bolt and washers that connect the DAA mechanism 100 to a column/supporting member and moment connection. In both example embodiments as illustrated, the DAA mechanism 100 is designed to be the fuse in the system that yields first in a seismic event or other force-producing event. Another example embodiment of the DAA mechanism 100 can be installed with a nut at the top to configurably control the amount of displacement that the DAA mechanism 100 can sustain. This ability to calibrate or configure the DAA mechanism 100 of various example embodiments allows designers to adjust or "dial in" the amount of force deflection the DAA system can experience. The DAA system is intended to not buckle in compression and only engage in tension forces.

Figure 7:
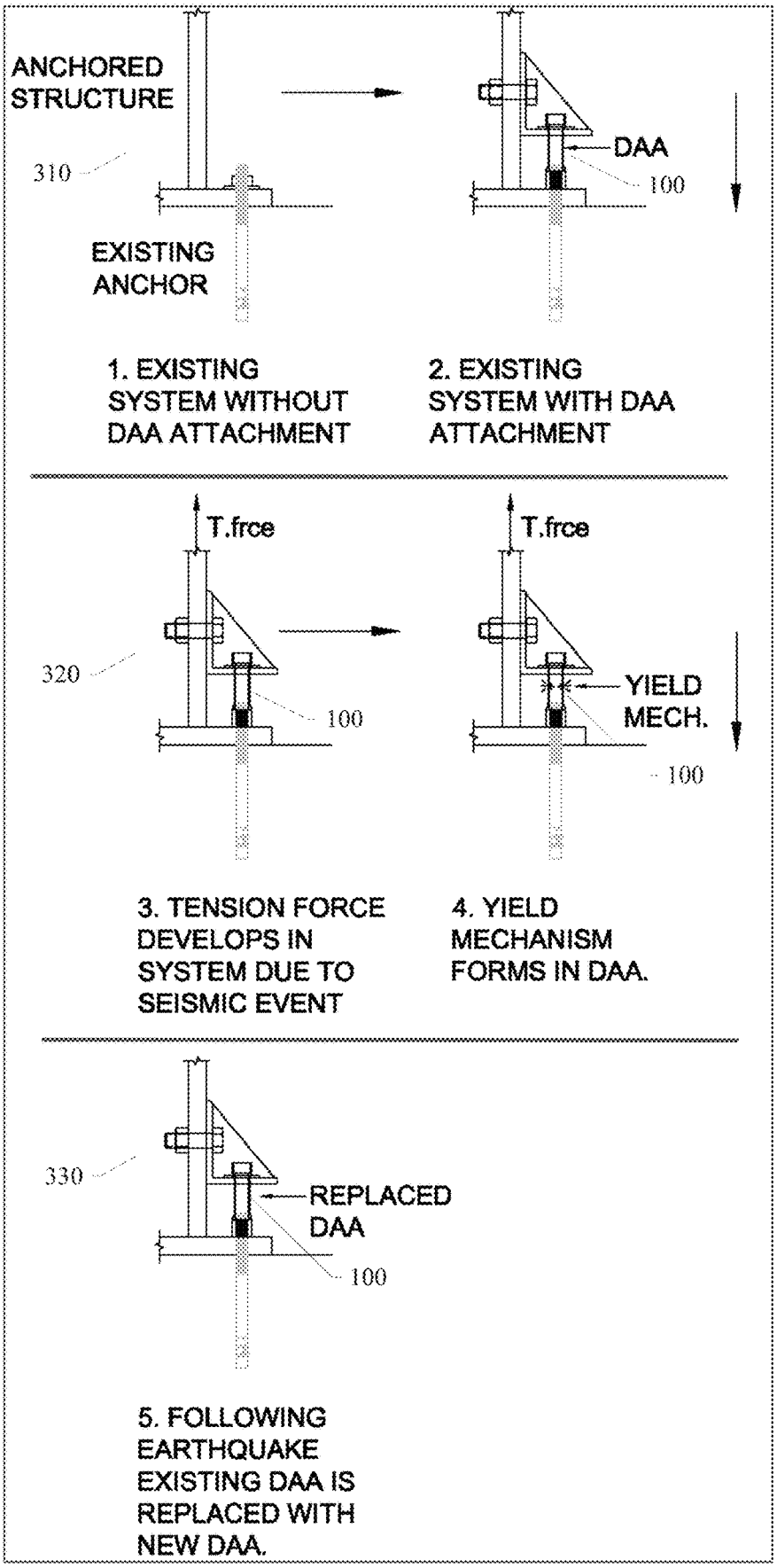
FIG. 7 illustrates a sample sequence of events in which the DAA mechanism of an example embodiment is intended to perform.

FIG. 7 illustrates a sample sequence of events in which the DAA mechanism 100 of an example embodiment is intended to perform. As shown in FIG. 7 at sequence event 310, the DAA mechanism 100 can be installed with or retrofit to an existing structural anchoring system. At sequence event 320, the structural anchoring system experiences tension force during a seismic event, for example. At a pre-defined and calibrated level of tension force, the DAA mechanism 100 undergoes a ductile yield while preserving the integrity of the remaining structural anchoring system. At sequence event 330, after the seismic or other event, the DAA mechanism 100 can be conveniently replaced without costly and extensive repairs to the existing structural anchoring system.

Figure 8:
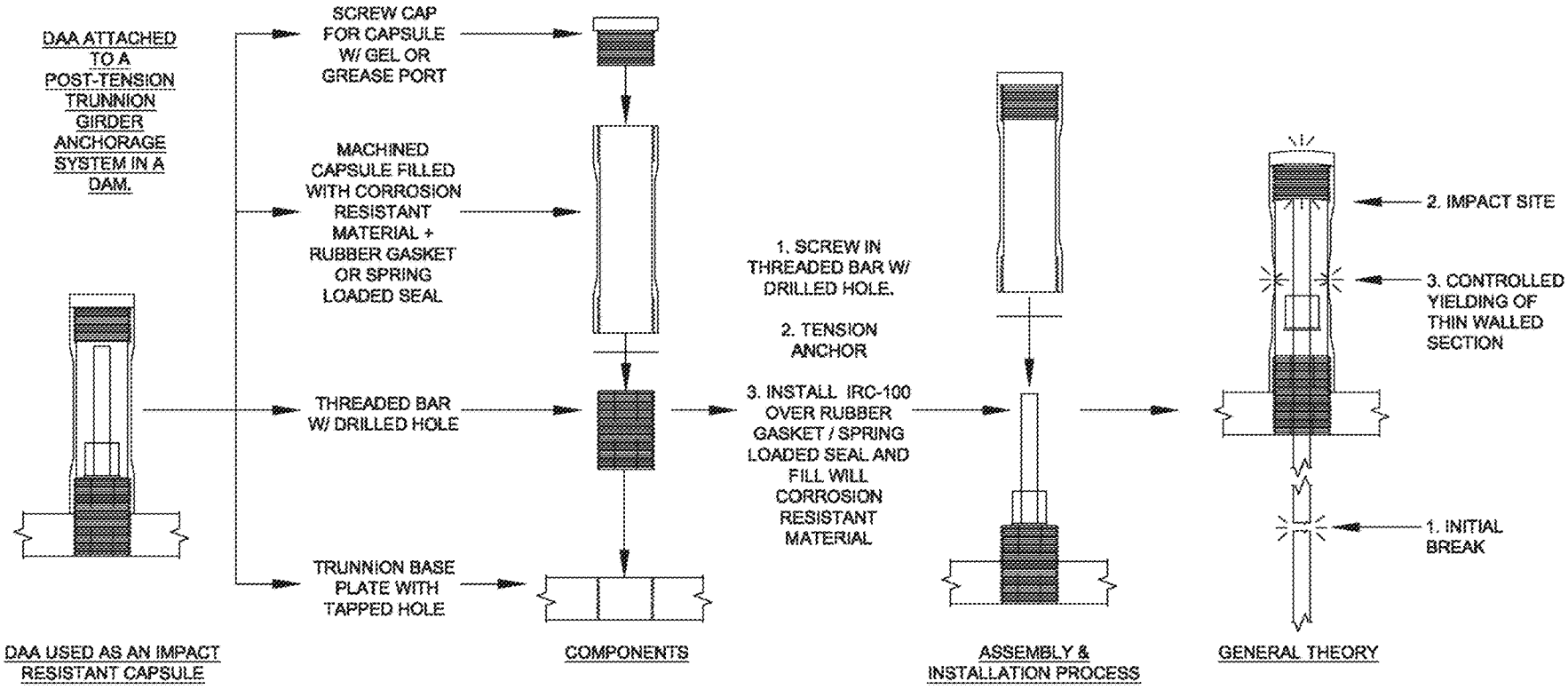
FIG. 8 illustrates another embodiment of a DAA mechanism as attached to a post-tension trunnion girder anchorage system.

FIG. 8 illustrates another embodiment of a DAA mechanism as attached to a post-tension trunnion girder anchorage system. In this embodiment, the DAA can be used as an impact resistant capsule. In an example of the use of the example embodiment, the DAA is attached to the ends of anchor heads in a post-tension trunnion girder. If an anchor fails, the anchor will impact the screw cap of the DAA. Following impact, the thin wall section of the capsule of the DAA will yield without damaging the bottom threads. Following incident, the DAA and anchor can be replaced.

As shown in FIG. 8, the components of the DAA of the example embodiment include a screw cap for the capsule with a gel or grease port, a machined capsule filled with corrosion resistant material, the capsule including a rubber gasket or spring loaded seal, a threaded bar with a drilled hole, and a trunnion base plate with a tapped hole.

The assembly of the components of the DAA of the example embodiment includes screwing the screw cap into the top of the capsule and screwing the threaded bar with a drilled hole into the trunnion base, tensioning the anchor, and installing the capsule over the rubber gasket or spring loaded seal and filling with a corrosion resistant material. As a result, the DAA of the example embodiment can be attached to a post-tension trunnion girder anchorage system where the DAA serves as an impact resistant capsule.

Lateral Force Resisting Example Embodiments

Referring now to FIGS. 9 through 14, example embodiments are illustrated that address lateral force resistance in addition to compression and tension forces. As described in more detail below, the DAA of example embodiments forms a plastic mechanism for a lateral force resisting system (plastic mechanism meaning the unique behavior of multiple anchors working together within a lateral force resist system or moment frame). This is a unique distinction as it requires a mechanism to form and not just the anchor to yield in compression or tension. In general, the DAA of example embodiments changes the system's fuse from the column/supporting member to the jacketed rebar, rod, or bolt of the DAA. As described in more detail below, the DAA creates controlled ductile yielding within the fuse to respond to compression or tension forces. Additionally, the anchors in the concrete are intentionally oversized to force a plastic mechanism to occur in the fuse only. As a result, fixity is shifted to the center of a column/supporting member base. The DAA system of the example embodiments as described below enable flexural forces transferred to the foundation to be adjusted up or down by designers, which offers greater design flexibility. Additionally, the disclosed DAA system is accessible to inspection and replacement, can be used on new or existing structures, and meets AISC and ACI requirements.

Figure 9:
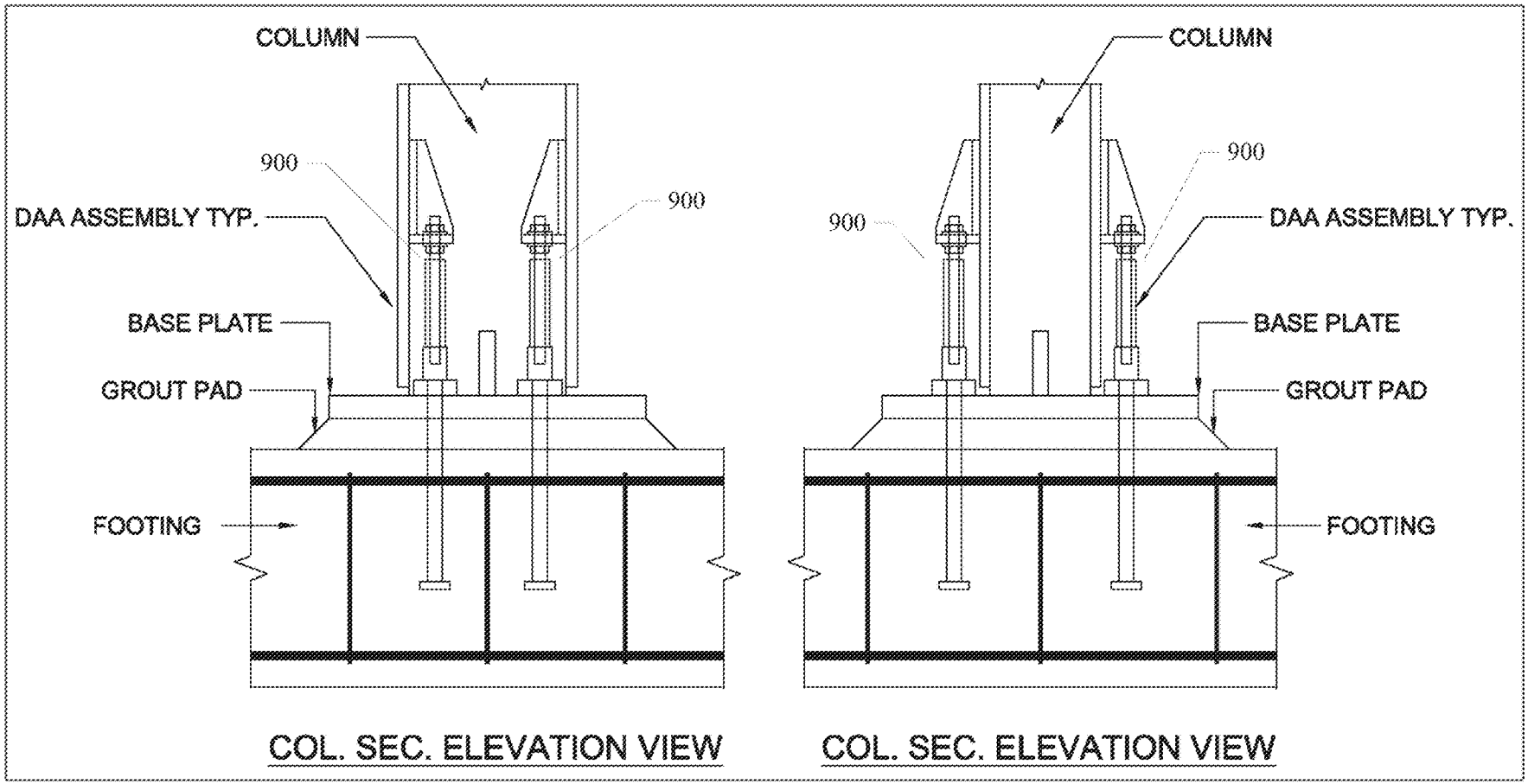
FIG. 9 illustrates an example embodiment of a DAA mechanism attached to a column or other supporting member.
Figure 10:
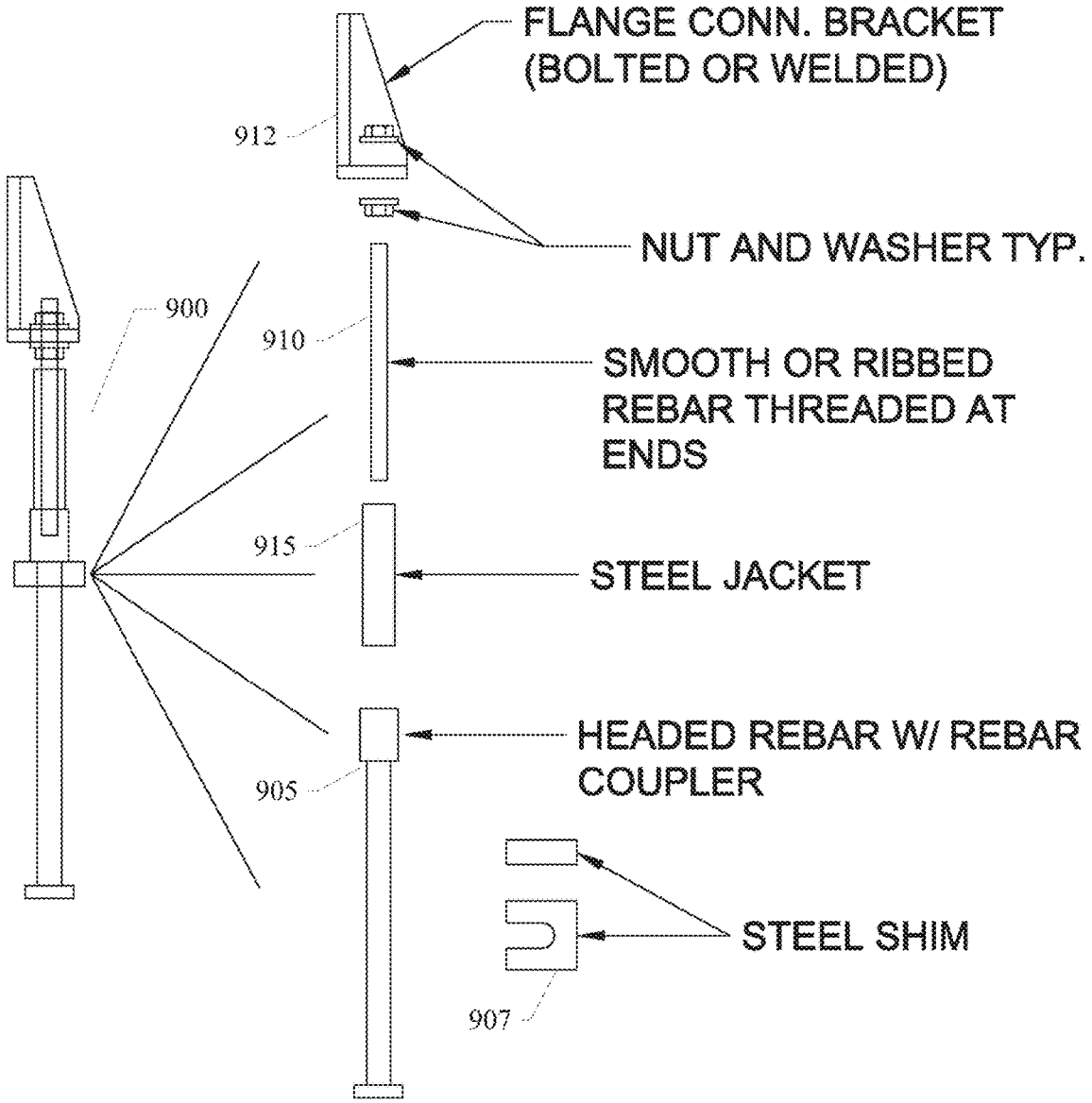
FIG. 10 illustrates the components and fabrication of a DAA mechanism according to example embodiments.

Referring now to FIGS. 9 and 10, the DAA system 900 of the illustrated example embodiment has replaced the tapered tubular neck of the DAA assembly described above with rebar, rod, or bolt segment 910 (whose neck may or may not have been modified) and metal (e.g., steel), composite, or 3D printed composite jacket 915 components as shown in FIGS. 9 and 10. In particular, the ductile anchor attachment (DAA) mechanism 900 of an example embodiment comprises: a headed rebar with a rebar coupler 905; the rebar segment 910 coupled to the rebar coupler 905 at a first end of the rebar segment 910; the metal jacket 915 encasing at least a portion of the rebar segment 910; and a flange connection bracket 912 coupled to the rebar segment 910 at a second end of the rebar segment 910. The rebar segment 910 can be fabricated from conventional smooth or ribbed steel, composite, or 3D printed composite rebar, rod, or bolt with threaded ends. The DAA system 900 of the illustrated example embodiment can further include shims made from steel, composite, or 3D printed composite coupled with the headed rebar, rod, or bolt 905. The DAA system 900 can be configured so the rebar segment 910 is threaded at the second and coupled to the flange connection bracket 912 with a nut and washer. It should also be observed that the bracket assembly (912, 900, 905, and 907) can be attached to either the flange, web, or any portion of a column/supporting member for different anchoring patterns. Additionally, the bracket assembly (912, 900, 905, and 907) can take the form of any of the brackets shown in FIG. 8 (4, 8, 9, 10, 11, 12, or 13) (e.g., welded, bolted, drilled and tapped and screwed, or glued).

Figure 11:
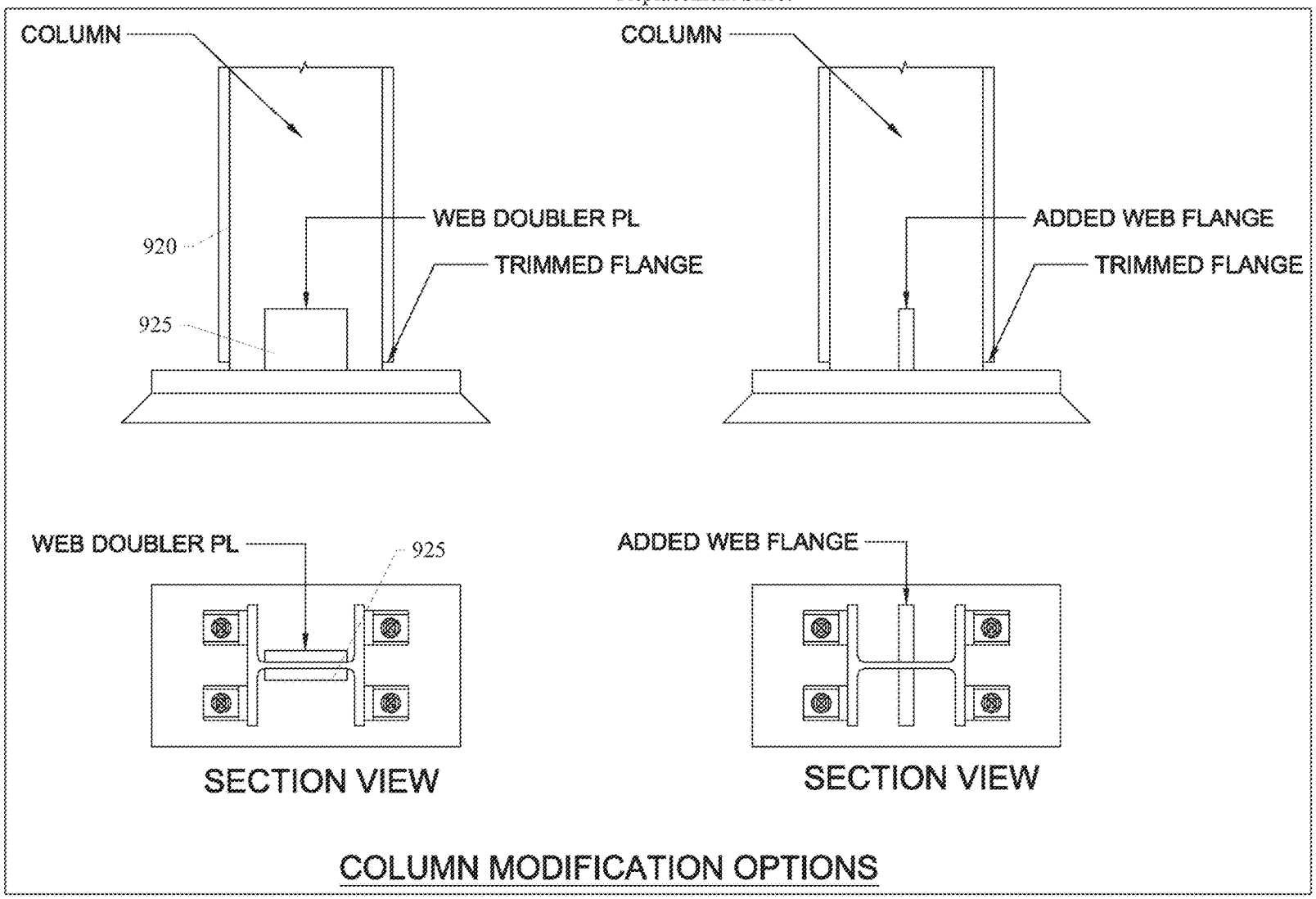
FIG. 11 illustrates an example embodiment of a DAA mechanism showing the trimmed flange and web doubler plate.

Referring to FIG. 11, the column/supporting member flange 920 is trimmed to restrict plastic deformation to only occur in the DAA. Trimming the flange 920 will prevent or reduce compression or tension forces from occurring in the flange 920, thus removing the column/supporting member's influence on the DAA system. Referring still to FIG. 11, a web doubler plate 925 or added flange of any shape can be used to improve axial capacity. Trimming the flanges 920 as described above can reduce the axial capacity of the steel column/supporting member significantly. Using doubler plates 925 or flanges attached in the middle of the column, as shown in FIG. 11, can help recover the lost axial capacity. In addition, relocating the added steel area of the doubler plates 925 to the center of the column/supporting member helps to mitigate the column/supporting member's influence on the DAA system. It is important to note that these column/supporting modifications are optional and are not required for the DAA system to function. Examples of unmodified columns/supporting members are presented below in connection with FIGS. 29 through 33.

Figure 12:
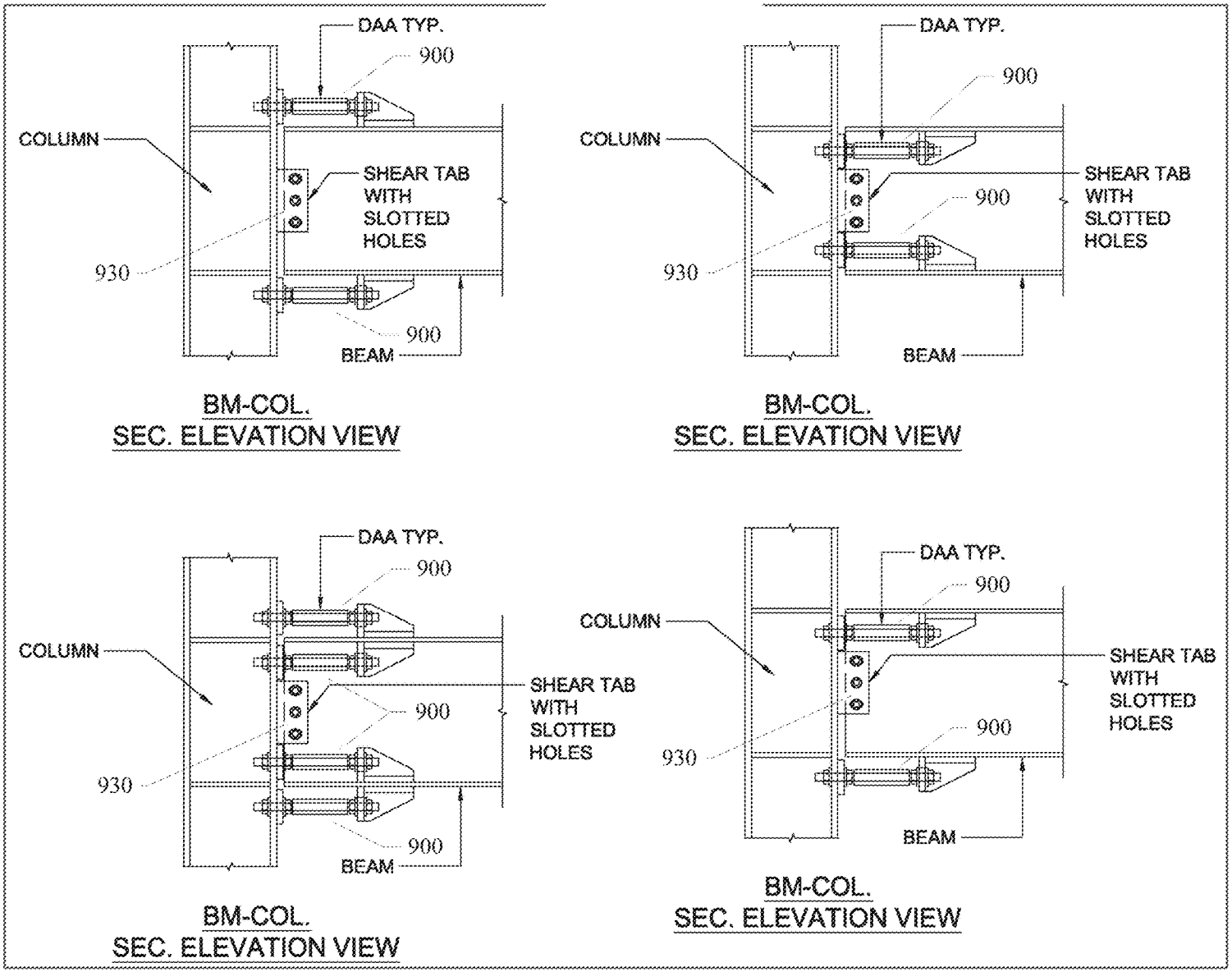
FIG. 12 illustrates an example embodiment of a DAA mechanism showing the shear tab with slotted holes.
Figure 13:
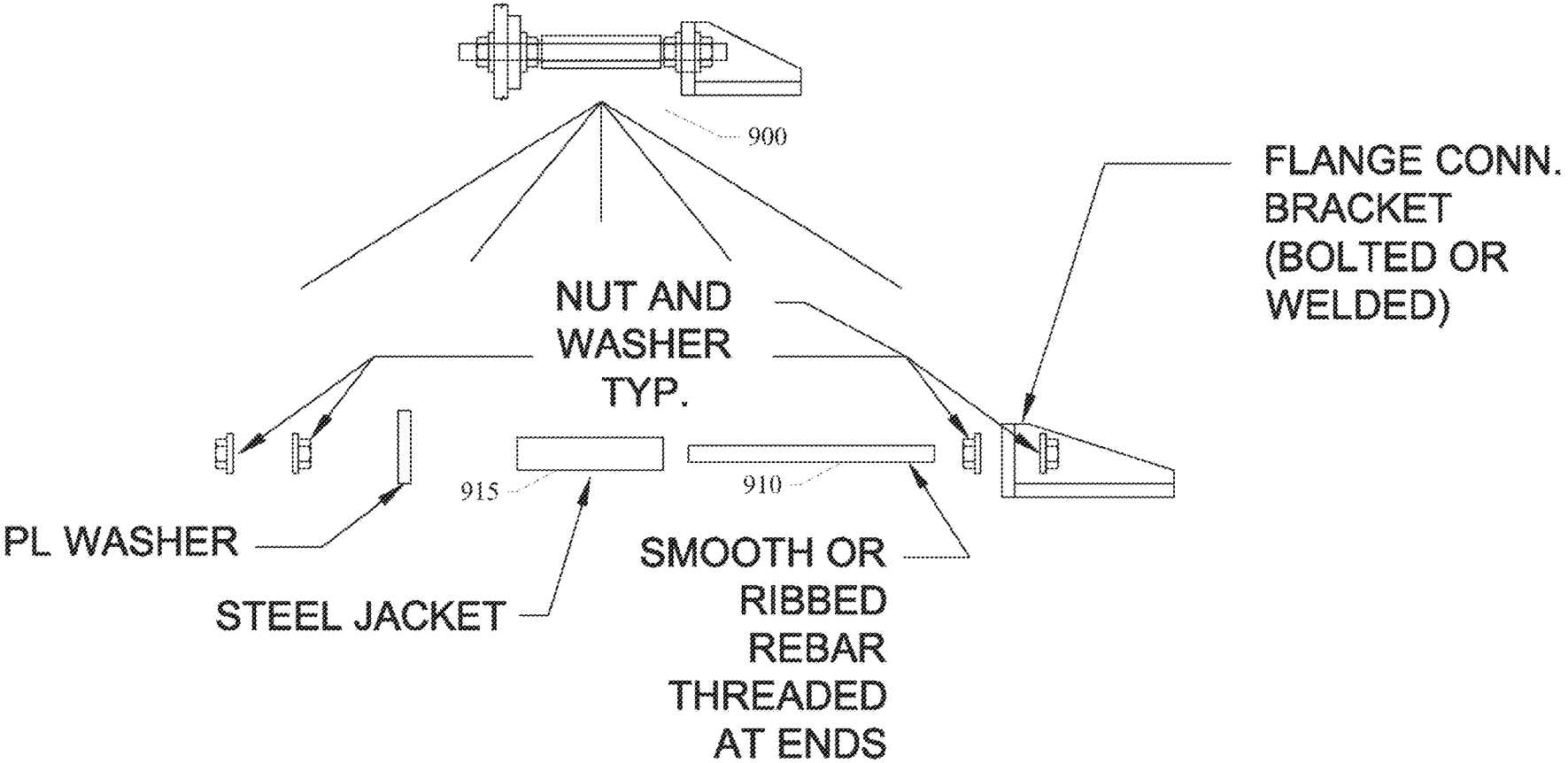
FIG. 13 illustrates the components and fabrication of a DAA mechanism according to example embodiments.
Figure 14:
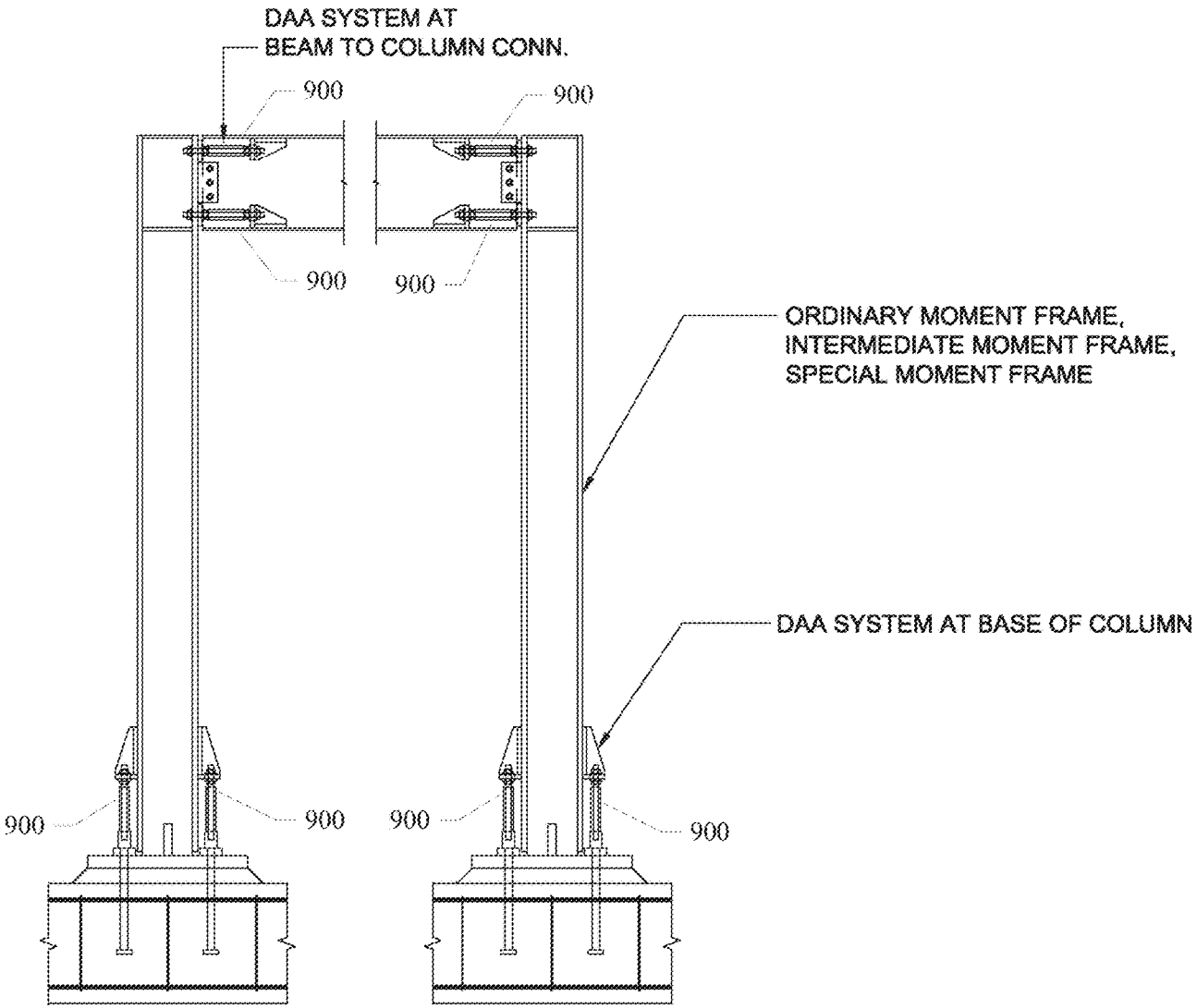
FIG. 14 illustrates an example embodiment of a DAA mechanism installed with a moment frame.

Referring now to FIG. 12, the DAA system of the illustrated example embodiment includes slotted holes in a shear tab 930 coupled between the column/supporting member and the beam. Slotting the holes in the top and bottom of the shear tab 930 allows the system to rotate as the DAA forms a plastic mechanism/moment couple. The code requires for this connection to undergo a certain amount of rotation to be acceptable and to be considered prequalified. The slotted holes in the shear tab 930 of the example embodiment enable this rotation.

As illustrated in FIGS. 9 through 14 and described herein, the DAA system 900 of the illustrated example embodiments can include the rebar, rod, or bolt segment 910 and jacket 915 components, the trimmed flange 920, the web doubler plate 925 or added flange, and the slotted holes in a shear tab 930 to allow the DAA to be plastic while the rest of the system remains elastic. As a result, the DAA system of the disclosed example embodiments provides structural engineers with the ability to increase or decrease fixity at the base of a column/supporting member that is part of a lateral force resisting system such as an Ordinary, Intermediate, or Special Moment frame. By creating variable fixity at the base of a column/supporting member, engineers can limit force transfer into the footing and control building drift. In addition, the DAA system as disclosed herein enables the transfer of the weak link from the column/supporting member and or foundation to the DAA to allow for easy replacement should yielding of the connection occur.

The DAA system as disclosed herein, through the use of multiple anchorages, allows the formation of a controlled plastic mechanism developed without negatively impacting a column/supporting member, the column/supporting member's foundation, or a beam. The disclosed DAA system can use multiple jacketed rebar, rod, or bolt (with or without a reduced cross section) to allow for the development of a plastic hinge or plastic mechanism to form with the governing failure modes being tension yielding or compression yielding. Currently there are no devices available that give structural engineers the following advantages in this manner:

- Foundation fixity flexibility for moment frames
- Beam connection fixity flexibility for moment frames
- Limited force transfer to foundation
- Limited force transfer to beam column/supporting member connection
- Limited force transfer to column/supporting member
- Damping of the moment frame system
- Story drift control
- Easy replacement
- Adjustable controlled plastic mechanism formation of multiple DAAs The disclosed DAA system, compared to conventional systems, can be specific to a moment frame system versus a braced frame system. The DAA targets and provides flexibility at its connection points (e.g., beam to column/supporting member and column/supporting member to foundation) allowing engineers to increase or decrease fixity based on lateral demands, thus mitigating force transfer and drift issues of a building structure. The disclosed DAA system also works together with multiple localized DAA components to form a symmetrical and controlled plastic mechanism for a specific column/supporting member or beam with limited influence from other structural elements of the building system or neighboring DAA systems in the same building system. The disclosed DAA system can also provide damping to the building, which will in turn decrease the building's stiffness and decrease force transfer into the building.

Example Embodiments of a DAA-Fuse Plate System

Figure 15:
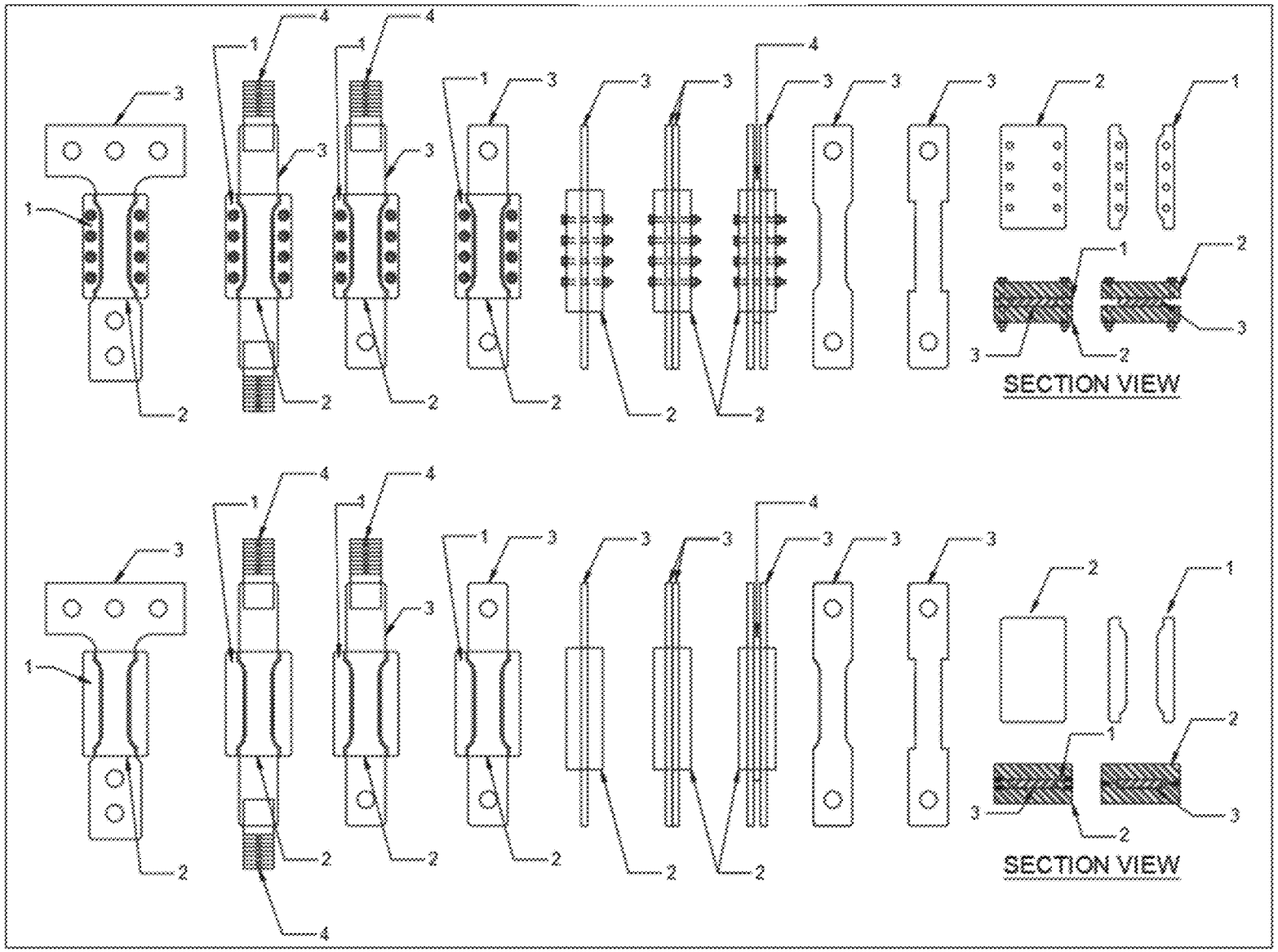
FIG. 15 illustrates thin plate or bar embodiments of a DAA mechanism as disclosed herein.
Figure 16:
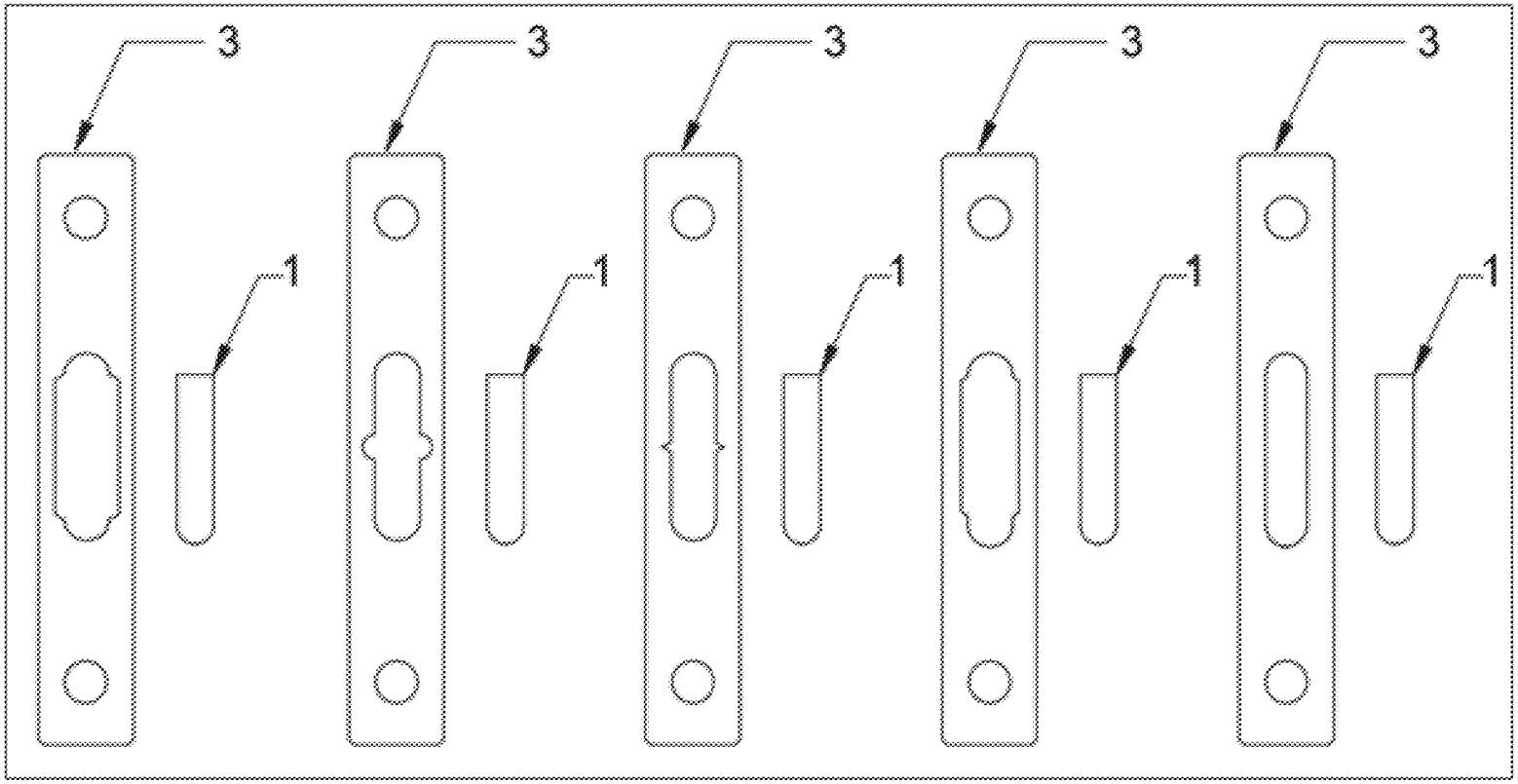
FIG. 16 illustrates alternative cut out variations of a DAA mechanism of example embodiments as disclosed herein.
Figure 17:
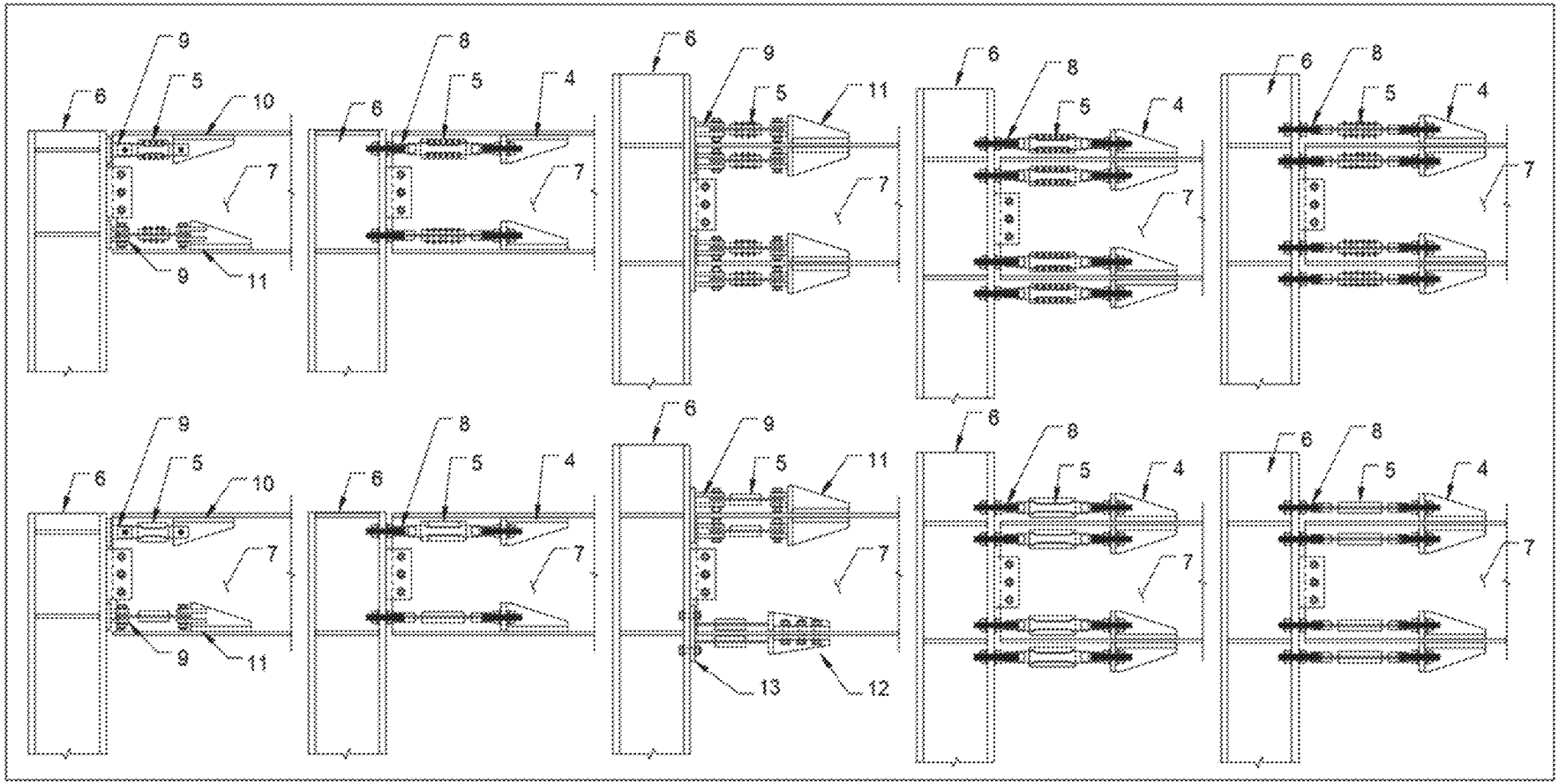
FIG. 17 illustrates beam to column/supporting member moment connection variations of a DAA mechanism of example embodiments as disclosed herein.
Figure 18:
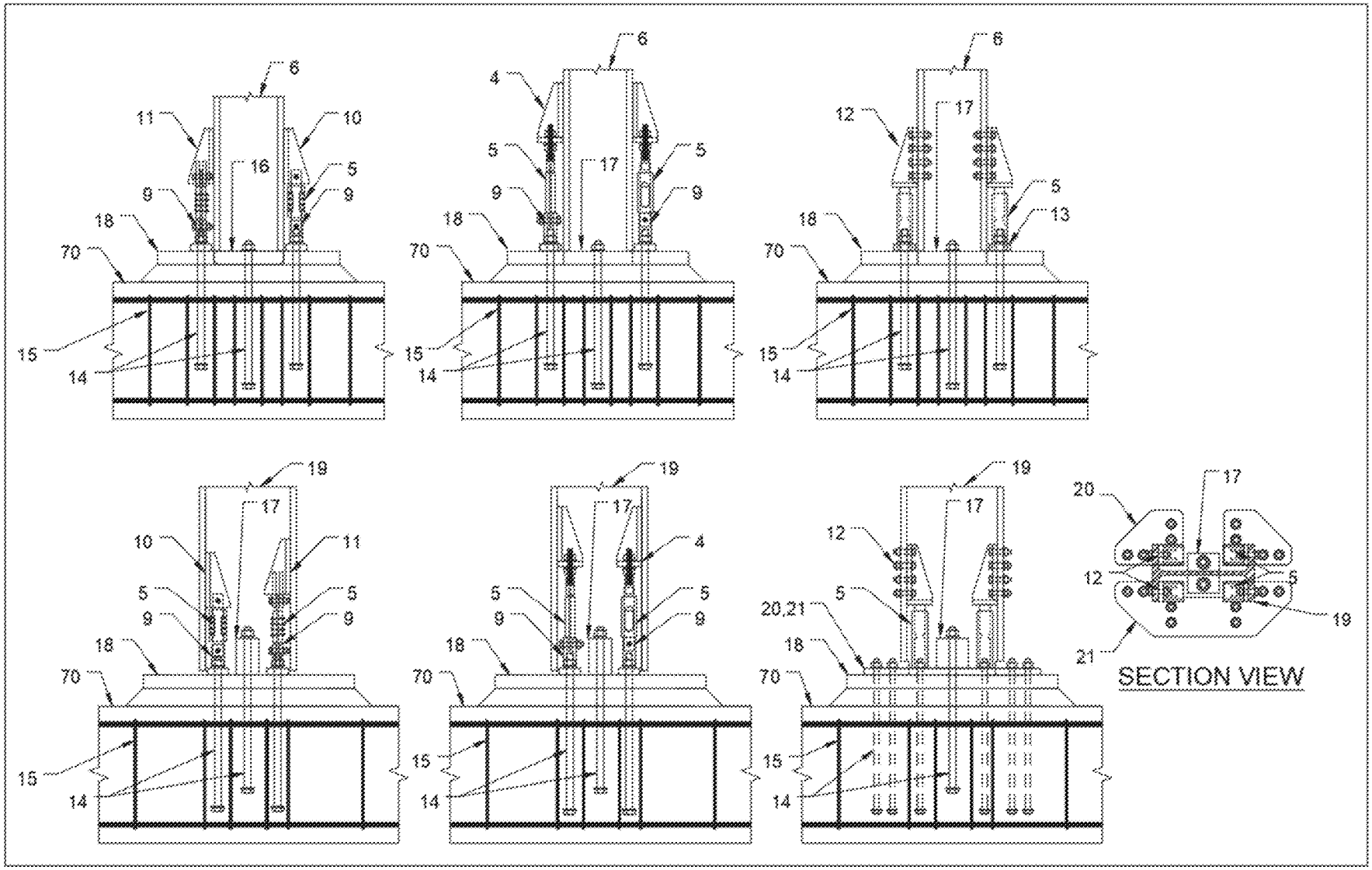
FIG. 18 illustrates a column/supporting member foundation application of a fuse plate system of example embodiments as disclosed herein.
Figure 19:
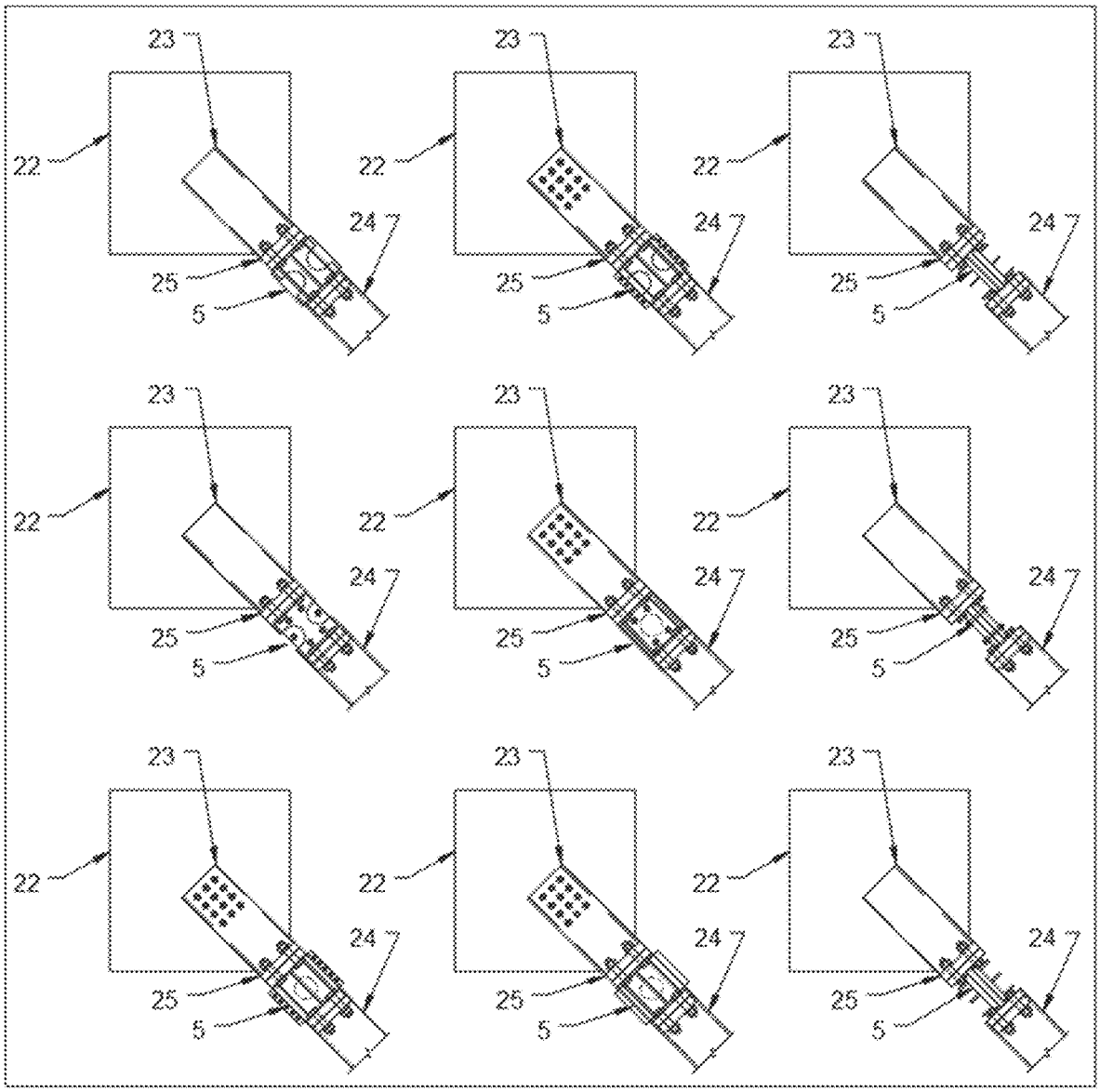
FIG. 19 illustrates variations of fuse plates attached to braces of example embodiments as disclosed herein.
Figure 20:
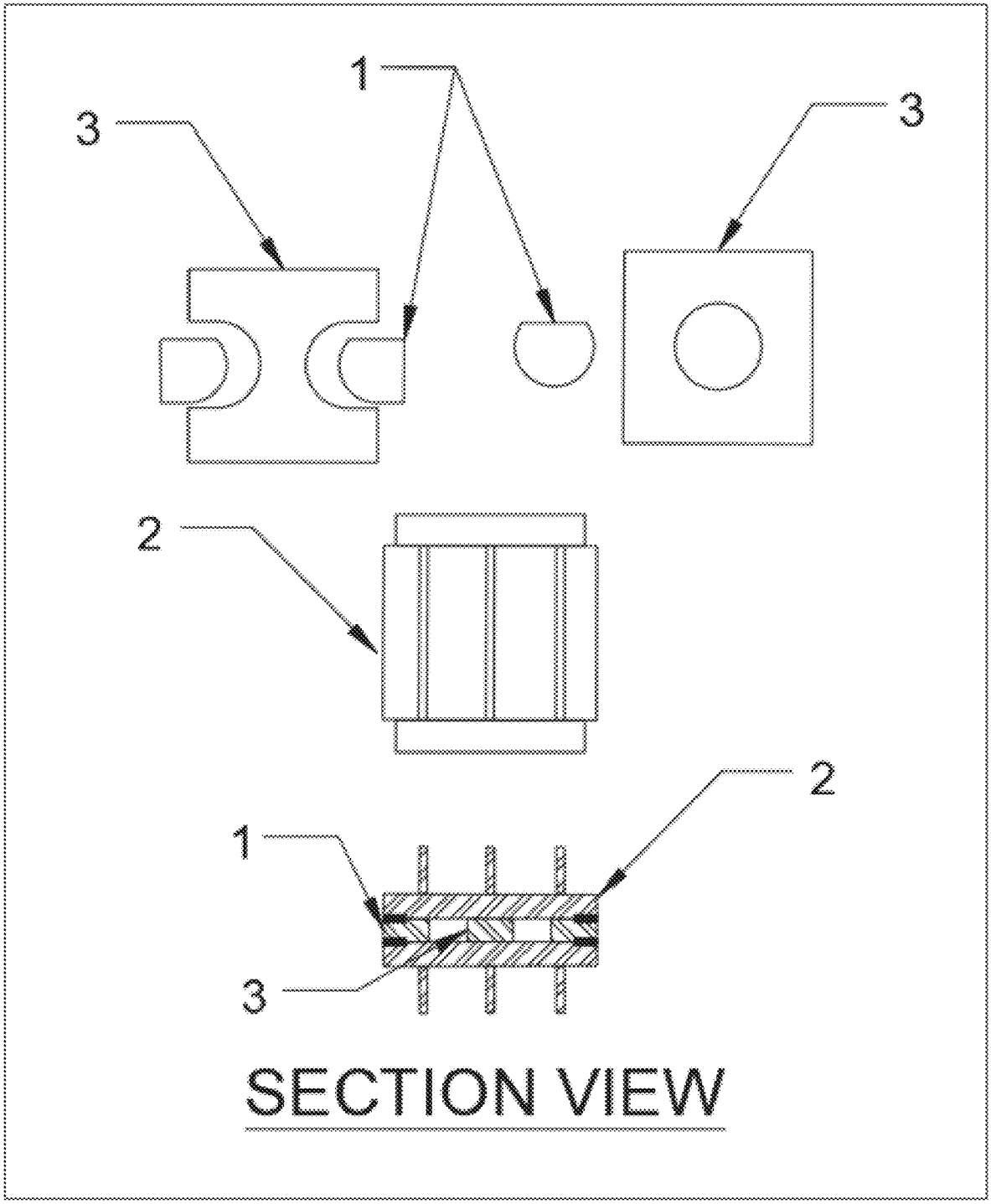
FIG. 20 illustrates components of the fuse plate system within a brace of example embodiments as disclosed herein.
Figure 21:
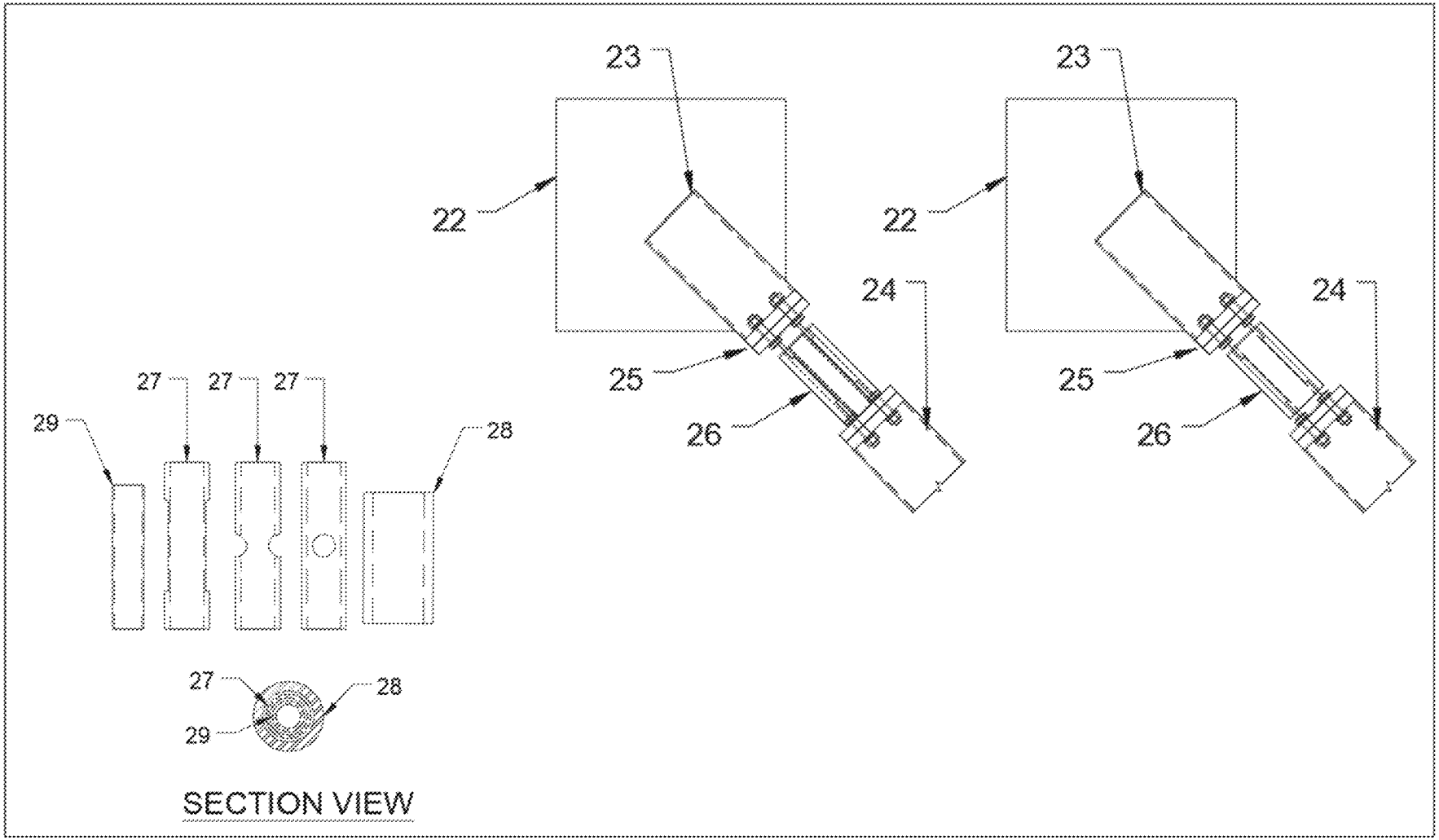
FIG. 21 illustrates a DAA system using tubular sections of example embodiments as disclosed herein.
Figure 22:
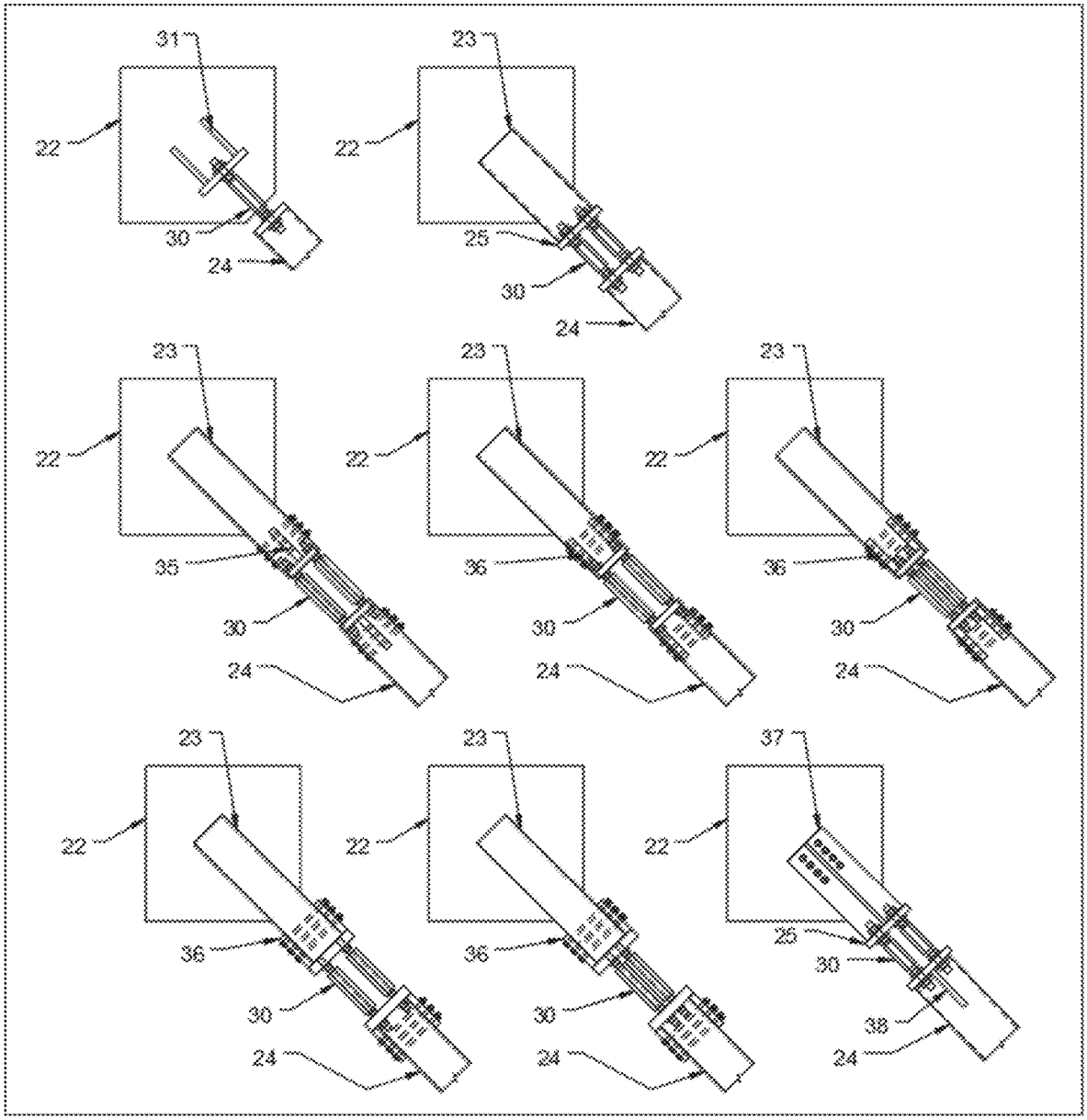
FIG. 22 illustrates a DAA system using singular and multiple jacketed rod assemblies of example embodiments as disclosed herein.
Figure 23:
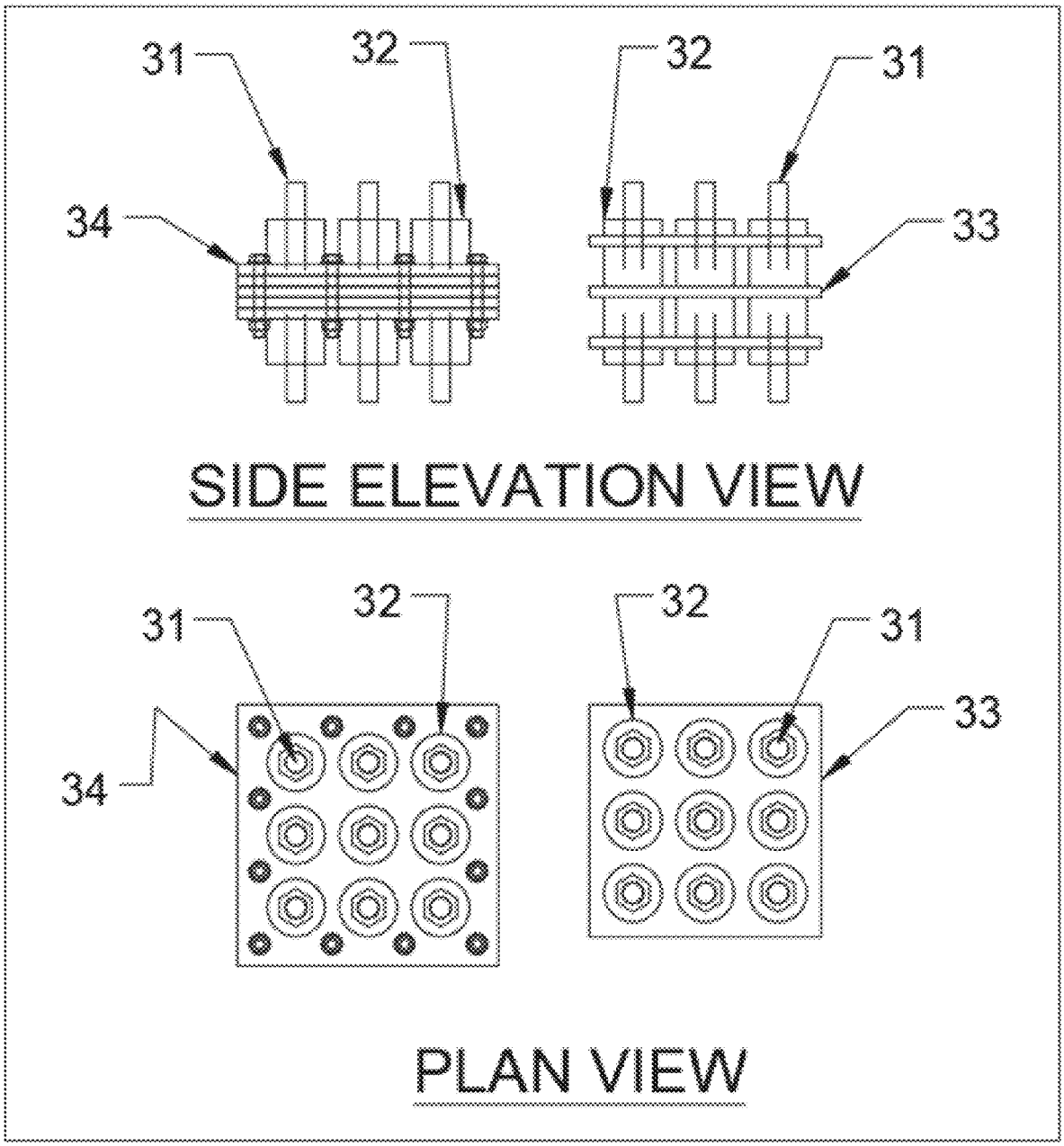
FIG. 23 and FIG. 24 illustrate components of a multiple jacketed rod assembly of example embodiments as disclosed herein.
Figure 24:
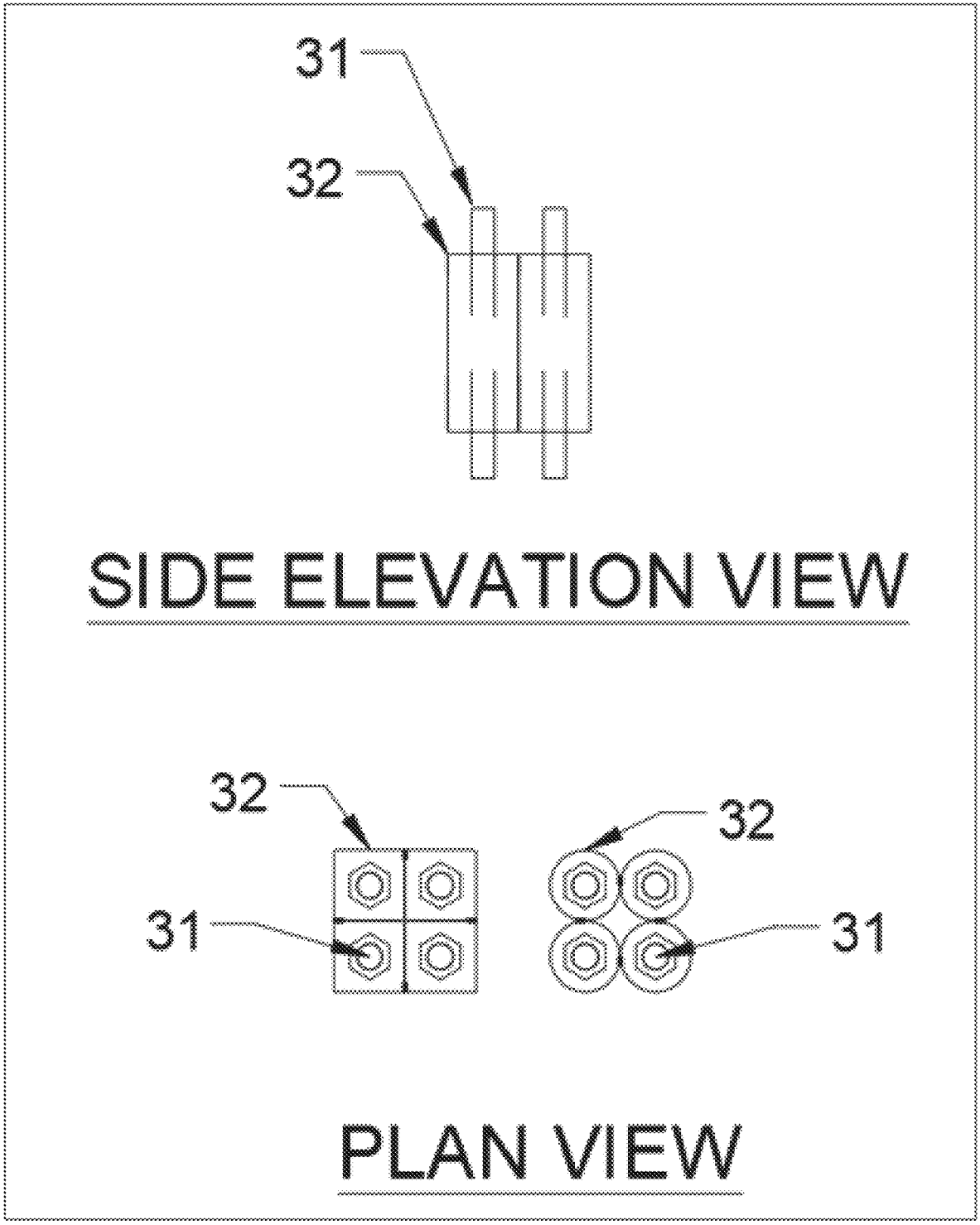
Figure 25:
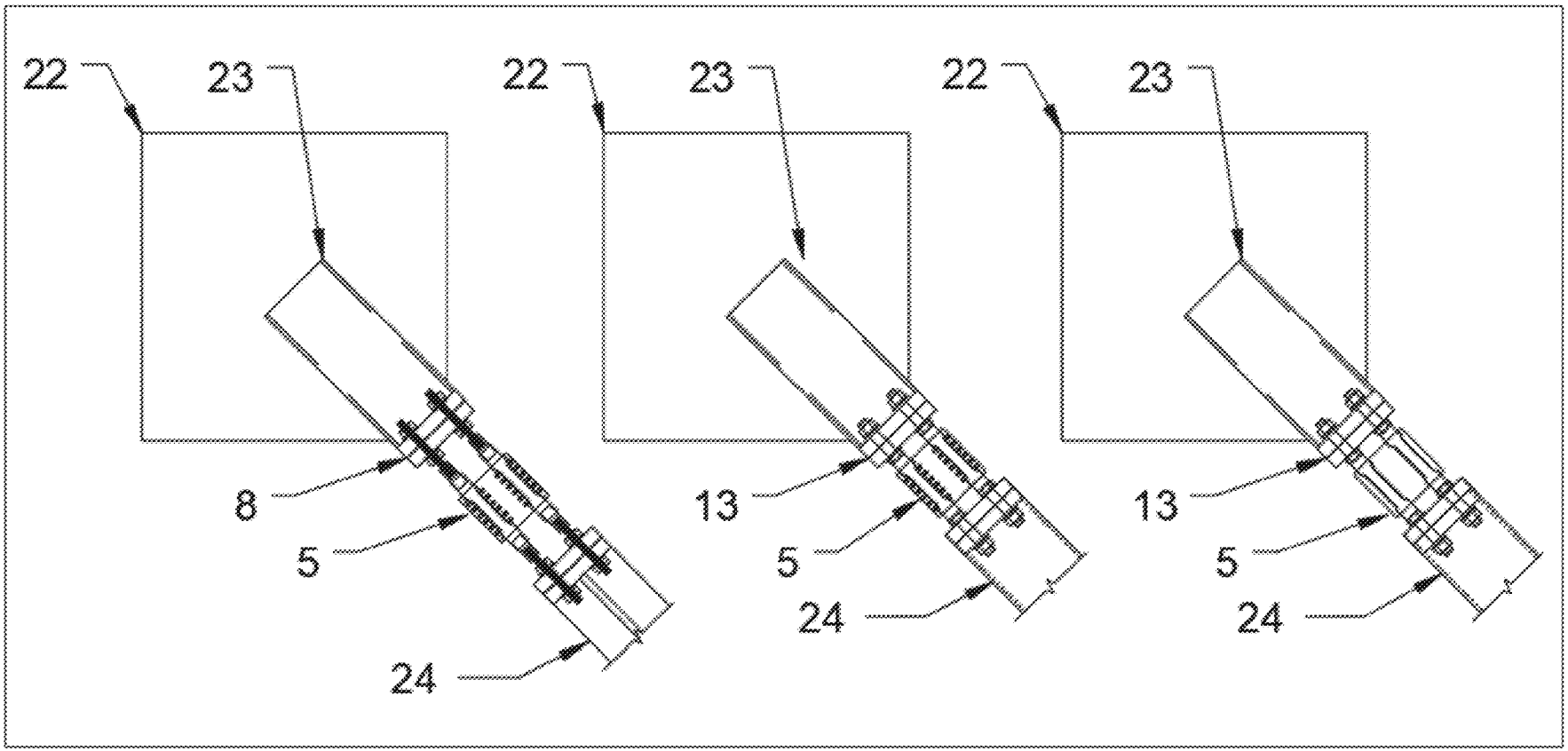
FIG. 25 illustrates fuse plates attached to braces of example embodiments as disclosed herein.
Figure 26:
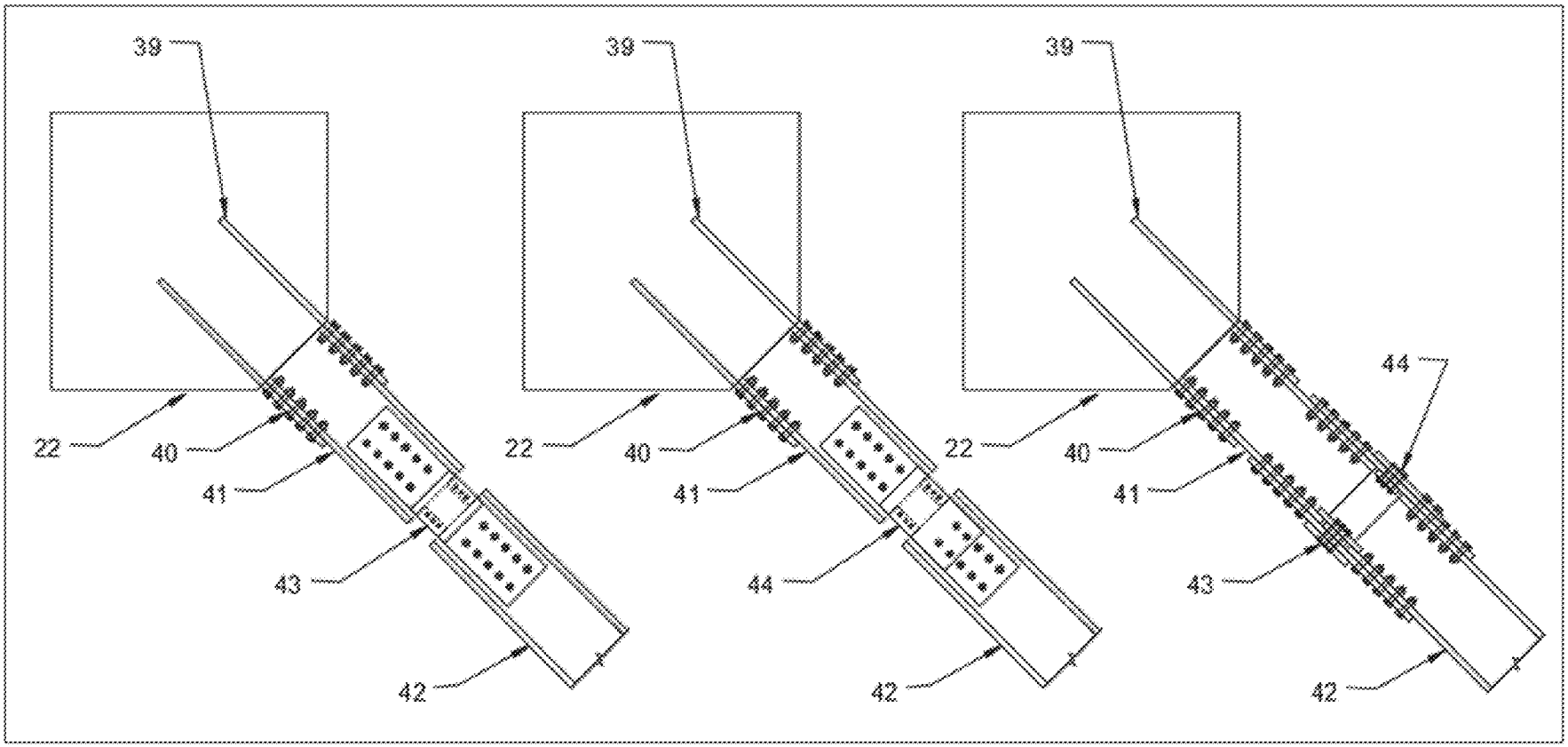
FIG. 26 illustrates fuse plates attached to a wide flange beam of example embodiments as disclosed herein.
Figure 27:
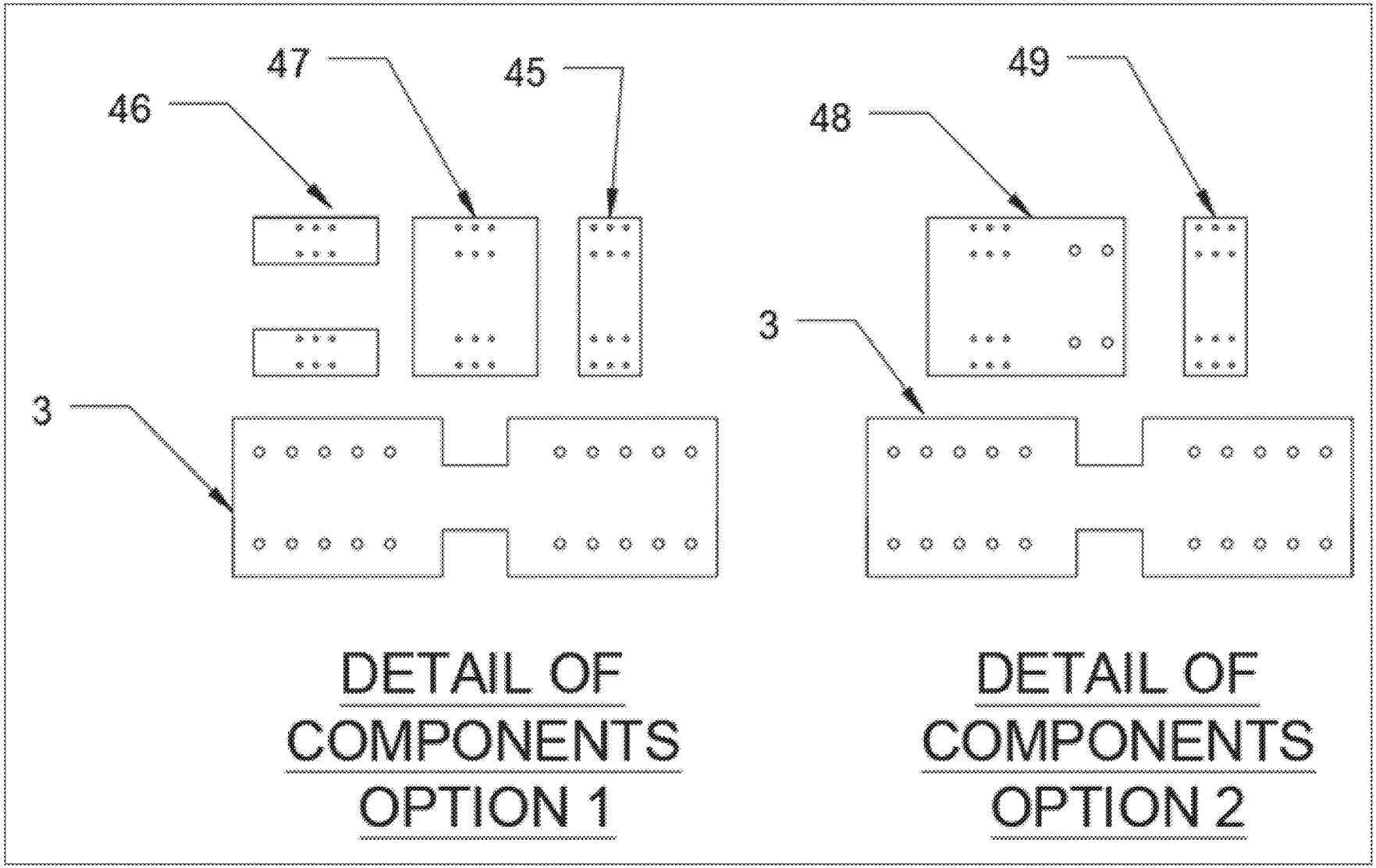
FIG. 27 illustrates components of a fuse plate system used on a wide flange cross section of example embodiments as disclosed herein.
Figure 28:
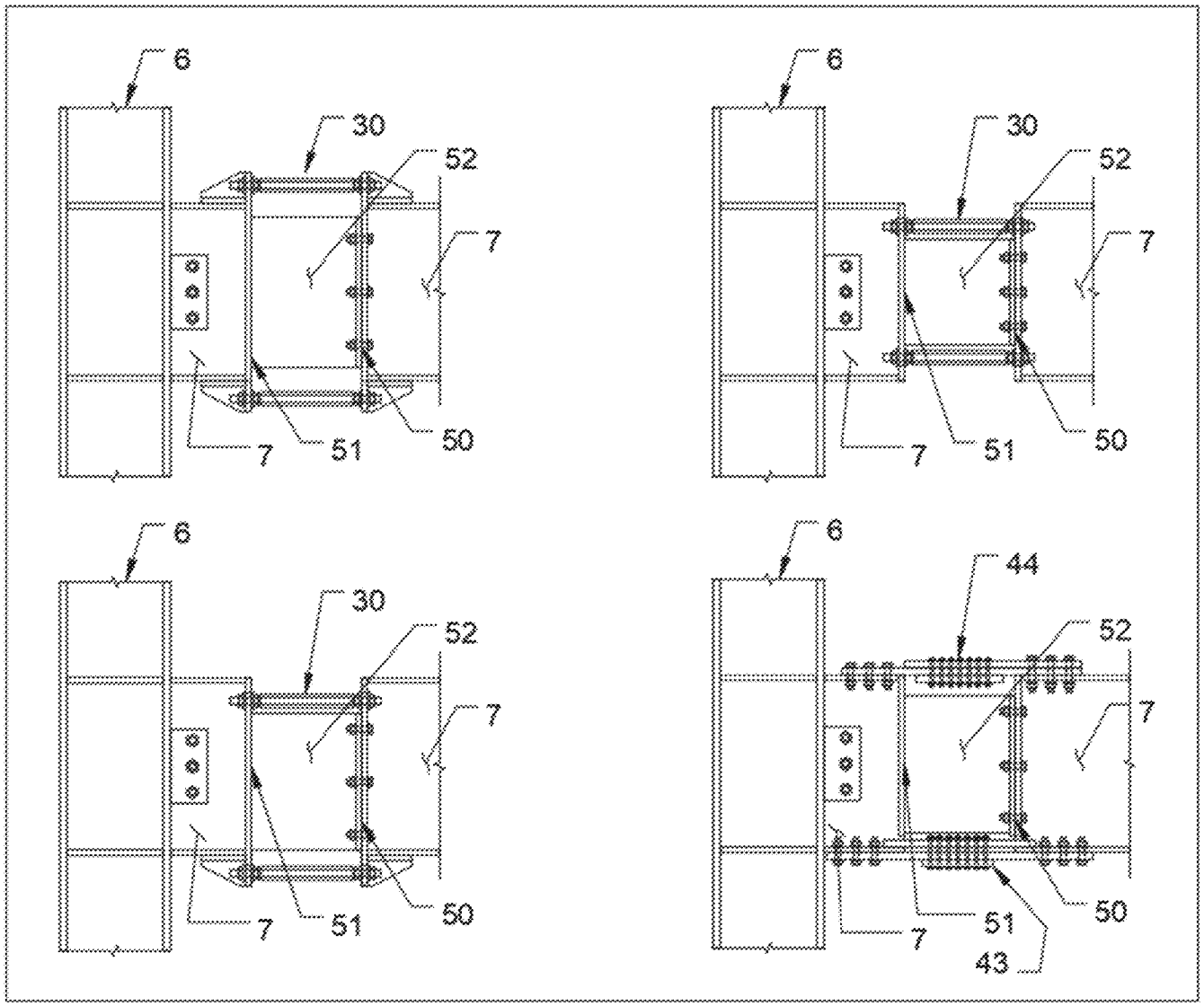
FIG. 28 illustrates a replaceable beam plastic hinge of example embodiments as disclosed herein.
Figure 29:
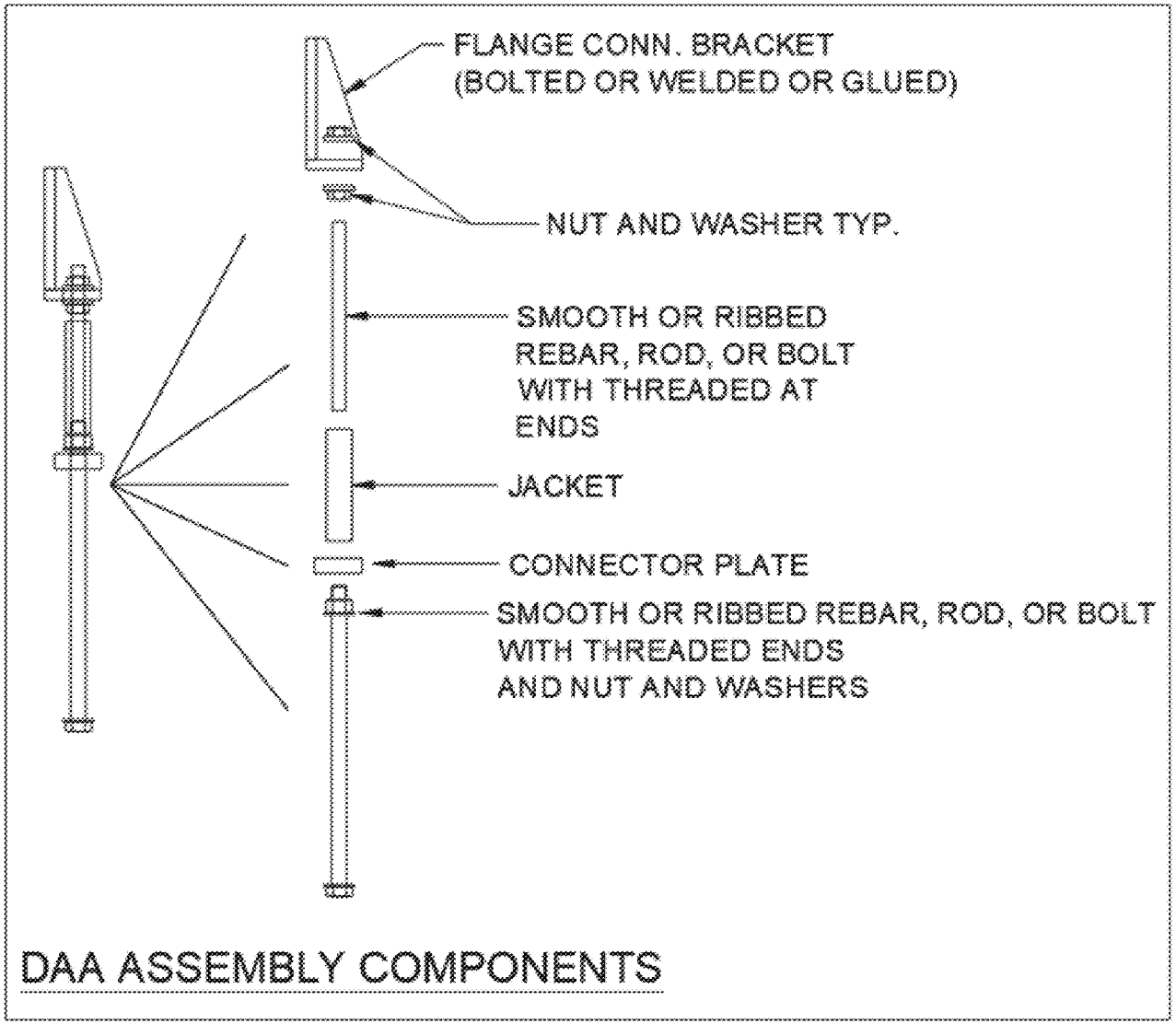
FIG. 29 illustrates DAA components for an unmodified column/supporting member base of example embodiments as disclosed herein.
Figure 30:
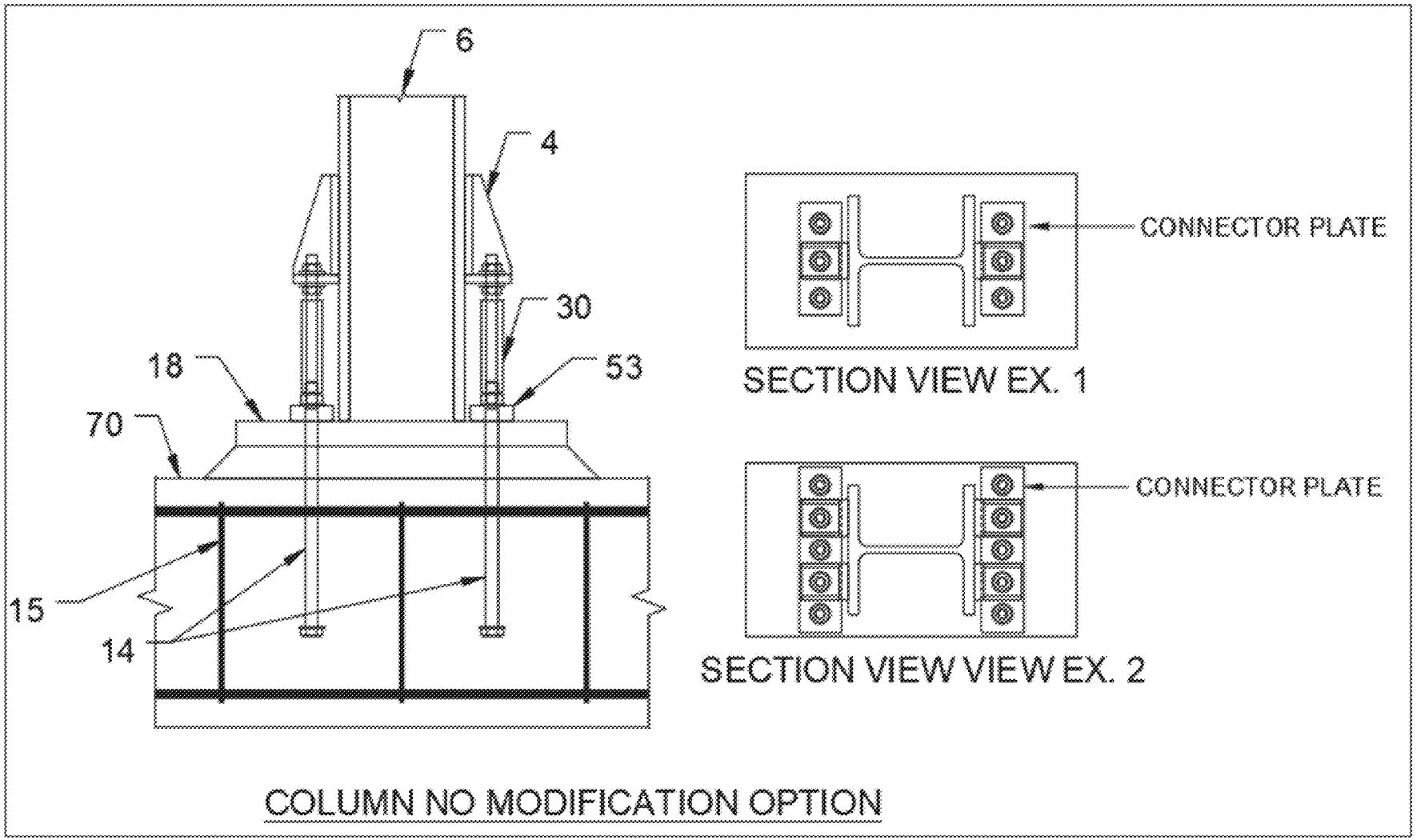
FIG. 30 illustrates a DAA system for an unmodified column/supporting member base of example embodiments as disclosed herein.

A variation of the ductile anchor attachment (DAA) referred to as a fuse plate as disclosed herein is presented in FIG. 15 through FIG. 30. In particular, FIG. 15 illustrates thin plate or bar embodiments of a DAA mechanism as disclosed herein. FIG. 16 illustrates alternative cut out variations of a DAA mechanism of example embodiments as disclosed herein. FIG. 17 illustrates beam to column/supporting member moment connection variations of a DAA mechanism of example embodiments as disclosed herein. FIG. 18 illustrates a column/supporting member foundation application of a fuse plate system of example embodiments as disclosed herein. FIG. 19 illustrates variations of fuse plates attached to braces of example embodiments as disclosed herein. FIG. 20 illustrates components of the fuse plate system within a brace of example embodiments as disclosed herein. FIG. 21 illustrates a DAA system using tubular sections of example embodiments as disclosed herein. FIG. 22 illustrates a DAA system using singular and multiple jacketed rod assemblies of example embodiments as disclosed herein. FIG. 23 and FIG. 24 illustrate components of a multiple jacketed rod assembly of example embodiments as disclosed herein. FIG. 25 illustrates fuse plates attached to braces of example embodiments as disclosed herein. FIG. 26 illustrates fuse plates attached to a wide flange beam of example embodiments as disclosed herein. FIG. 27 illustrates components of a fuse plate system used on a wide flange cross section of example embodiments as disclosed herein. FIG. 28 illustrates a replaceable beam plastic hinge of example embodiments as disclosed herein. FIG. 29 illustrates DAA components for an unmodified column/supporting member base of example embodiments as disclosed herein. FIG. 30 illustrates a DAA system for an unmodified column/supporting member base of example embodiments as disclosed herein. Each of these example embodiments of a DAA fuse plate system is described in detail below.

Referring to FIG. 15, the fuse plate 3 of the example embodiments is composed of a flat steel, composite, or three dimensional (3D) printed composite plate or bar, with a neck that is narrowed or modified to promote yielding of the material by creating a weakened zone in the plate through the removal or omission of a portion of the material to concentrate stress. To prevent the weakened zone from suffering a brittle failure mode (i.e., buckling), the weakened zone is encapsulated within a jacket 2 made from steel, composite, or 3D printed composite material. The jacket 2 is composed of outer connecting plates that are either welded, glued, drilled and tapped and screwed, or bolted together. Spacers 1, made of steel, composite, or 3D printed composite material, may also be used along the sides of the jacket, but are not necessarily required. The ends of the flat bar can be tailored to connect to a variety of brackets, wherein the brackets can include:

- a coupler to connect to one or multiple bolts oriented to take tension
- a drilled hole or holes to connect to one or multiple bolts oriented to take single or double shear
- a welded connection to one or more plates
- a glued connection to one or more plates The fuse plate of the example embodiments is intended to provide controlled yielding of the weakened zone in tension and compression during a lateral loading event on a building or non-building structure (e.g., earthquake, wind, blast, etc.).

Subsequently, the fuse plate is intended/designed to be easily replaceable following the lateral loading event. Other features of the fuse plate include the ability to be stacked side by side or spaced to create redundancy. The fuse plate can be rotated to any desired orientation. Additionally, the fuse plate can be fabricated in a variety of forms as a tapered neck as shown in FIG. 15. The fuse plate can also be fabricated in a variety of forms from a wide variety of cut-outs 3 other than a tapered neck as shown in FIG. 16. Like the previous examples, these cut-outs are housed within the jacket 2 and may or may not be included with spacers and may or may not be included with a portion of the cut-out 1 to provide additional internal bracing of the weakened zone.

The small versatile design of the fuse plate can be constructed on either side of a wide flange beam 7 or column/supporting member 6 as demonstrated in a column/supporting member to beam moment connection as shown in FIG. 17 and a column/supporting member to foundation connection shown in FIG. 18. Attachment of the fuse plate can come in variety of brackets represented by (4, 8, 9, 10, 11, 12, or 13). The brackets can be welded or glued 4, accommodate a threaded end 8, accommodate a bolt in double shear (9, 10, or 11), and or can be bolted with connector plates (12 or 13). Although not shown in the drawing, the connections shown in FIG. 17 can be composed of stacked or spaced fuse plates. Also shown in FIG. 18 are various ways to modify the column/supporting member to the foundation 70 to create a partially rigid connection or pinned foundation condition and to help isolate plastic stress/strain/deformation development. Specifically, this entails cutting or separating the base plate that supports the column/supporting member (16, 17, or 18) from the DAA supporting connector plates (18, 20, or 21) or machining the ends of the base plate with a radius in contact with the concrete foundation 13. Depending on the demands, this may or may not be needed. Modification to the column/supporting member 6 is not required for the DAA/fuse plate assemblies 5 to function properly. Examples of unmodified columns/supporting members 6 supporting variations of the DAA, fuse plates, and or modified jackets are presented below in connection with FIGS. 29 through 33. Also shown in FIG. 18 are supporting anchors 14 that connect the column/supporting member (6 or 19) to the foundation 70, and rebar 15 within the foundation 70. It should also be observed that brackets (4, 8, 9, 10, 11, 12, and 13) may be attached to either the flange, web, or any portion of a column/supporting member (6 or 19) to support different anchoring patterns.

The fuse plate assembly can also be attached to braces within a braced frame system. As shown in FIG. 19, the fuse plate assembly 5 is placed in between two bracing members (23 and 24), one of which is attached to a gusset plate 22 using a bolted end plate connection 25. As shown in FIG. 20, the jacket 2 is provided around the fuse plate 3 to prevent buckling and encourage controlled yielding (of the fuse plate) in tension or compression. The jacket 2 can be either welded, glued, or bolted together and provided with additional stiffeners for added rigidity, but stiffeners are not necessarily required. Additionally, to provide additional buckling support, an internal element closely matching the cut out made in the fuse plate 1, can be inserted into the jacket. However, depending on the needs, this feature may not be required. As the brace is subjected to lateral loading, the brace will be subjected to either tension or compression loading. Should the axial load be large enough, the fuse plate will eventually yield and dissipate energy in a controlled manner. Following the lateral loading event, the fuse plate, like the other embodiments, can be replaced thus restoring functionality and load capacity to the bracing system. Variations accomplishing the same behavior are illustrated in FIG. 21 through FIG. 25. Different fuse plate or DAA assemblies (5, 26, or 30) can be used in between braces (23, 24, 31, 37, and 38), which are in turn wrapped within a steel, composite, or 3D printed composite jacket (2 or 28), and if needed, accompanied with an internal bracing member 29. The jackets (2 or 28) can be of welded, glued, drilled and tapped and screwed, or bolted construction and can be welded, glued, or bolted to neighboring jackets, if so desired. Brackets attaching the fuse plates or DAA (8, 13, 25, 35, or 36) can be designed to attach on the inside or outside of various structural sections like hollow structural sections (HSS) or make use of end plates. Fuse plates and/or DAA assemblies are attached to brackets using through bolts, welds, glue, tapped holes, bolts in double shear, or a combination of these attachments. It is important to note that the fuse plates and or DAA's (3 or 27) can be tailored to attach to a wide range of structural members including: HSS, channels, wide flange sections, angles, WTS, crucible, and built-up sections. Multiple fuse plates and/or DAA's can also be assembled to work as a redundant load path system, as illustrated in FIG. 23. Rods 31, made from steel, composite, or 3D printed composite material, pass through a jacket 32, made from steel, composite, or 3D printed composite material, which in turn is attached via welds, bolts, drilled and tapped holes with screws, or glued to a single, stacked, or spaced plate system (33 and 34) made from steel, composite, or 3D printed composite material. Additionally, the plate system (33 and 34) may be omitted and the jackets 32 can be attached to each other via weld, bolts, or by glue as shown in FIG. 24. It should be observed, within FIG. 21, the fuse 27 depending on its overall length and slenderness ratio, may not require either an external or internal jacket to prevent the onset of buckling. Similarly, within FIG. 23, depending on the fuses 31 overall length, modification, and slenderness ratio, the jacket 32 and space plate system 33 may not be required.

FIG. 26 and FIG. 27 illustrate how a fuse plate system (43, 44) can be attached to the flanges or webs of a W-section, channel, WT, or built-up member (41, 42), via weld, bolt, drilled and tapped holes with screws, or glue, with a weakened zone sandwiched between two welded, bolted, drilled and tapped and screwed, or glued plates (44, 46, 47, 48, and 49) made from steel, composite, or 3D printed composite material. For the fuse plate system 43, the weakened zone of the fuse plate 2 is jacketed via a sandwich plate assembly composed of two outer plates (46, 47) and a spacer plate 45. The two outer plates of the jacket (46, 47) do not connect positively to the flanges or webs of either brace (41, 42), but rather bridge across the brace gap and only bear on the flanges or webs, thus allowing the system to slide freely during ductile yielding, but provide bracing support to the fuse plate. A variation of this system is provided as shown for fuse plate system 44. This system, like fuse plate system 43, utilizes a sandwich plate assembly to also brace the weakened zone of the fuse plate. For this jacketed system, composed of only two outer plates (48, 49), the outer plate 48 is connected positively to single brace flange or web (41, 42), but does not connect to both brace flanges or webs (41, 42), and the inner plate 49 is connected positively to plate 48 only, via weld, bolts, drilled and tapped holes with screws, or glue. The sandwich plate assembly 44, like fuse plate system 43, also allows for ductile yielding to occur, thus allowing the system to deform freely, while providing bracing support to the weakened zone of the fuse plate 3. It is emphasized that neither the flanges nor the webs of either brace (41, 42) are used for the purpose of bracing a given fuse plate's 3 weakened plane. This is solely accomplished by the sandwich plate assemblies (43, 44). It should be observed that the sandwich plate systems (43, 44), if connected to a web of a brace member (41, 42), may be composed of one or two fuse plates 3 (one on either side of a web) that are braced by the jacketed assembly (43, 44). In the case of the jacketed assembly 44, two outer plates 48 are needed for a two-fuse plate system. Additionally, for a two-fuse plate system, a spacer plate 45 may or may not be utilized between the two fuse plates 3 to assist in the ductile yield mechanism formation.

FIG. 28 illustrates a replaceable plastic hinge zone within a beam system 7 using either fuse plates (43, 44) or 5 (not shown) or a ductile anchor attachment assembly 30. Fuse plates (43, 44) or a DAA system 30 can be connected to the beam 7 via weld, bolts, drilled and tapped holes with screws, or glue, which act as modified flanges of the beam system 7 that can dissipate energy during a lateral event. Shear support for the beam system 7 is a web plate 52 that is connected to beam 7 via an end plate system (50, 51), which can be welded, bolted, drilled and tapped and screwed, or glued to the beam system 7 or web plate 52 to create a positive connection. The web plate can be made from steel, composite, or 3D printed composite material and can be tailored to meet the demands of the system and may or may not undergo plastic deformation. Additional stiffener bracing (in a horizontal or vertical arrangement) can be provided to the web plate 52, but this may or may not be needed depending on the demands of the system. The replaceable plastic hinge system is designed to be fully replaceable. Depending on the damage, repair teams can shore up beam 7 and swap out the fuse plate system (43, 44) or DAA's 30 and/or the web plate 52. It should be observed that the fuse plates (43, 44) do not attach to the column/supporting member and do not positively connect to the beam 7 at the weakened zone of the fuse plate. Both fuse plate systems (43, 44) utilize the sandwich jacket system described in FIG. 26. It should also be observed that the DAA's 30 could be replaced with other embodiments of the DAA, the fuse plate, or the modified jacket configurations described herein.

FIG. 29 and FIG. 30 illustrate an unmodified column/supporting member 6 utilization of the DAA 30. Using a connector plate 53, the system will help prevent plastic strain, stress, or deformation from entering the column/supporting member 6 with the DAA 30 dissipating most of the energy through controlled tension and compression yielding. It should also be observed, that by not directly connecting to the anchors 14, but rather connecting via a connector plate 53 resting on the base plate 18 freely (i.e., not positively attached to the base plate 18), damage to the anchors 14 can be avoided, thus avoiding costly repairs or replacement of the anchors embedded in the concrete foundation 70 reinforced with rebar 15. It should also be observed that the brackets (4) may be attached to either the flange, web, or any portion of a column/supporting member (6) for different anchoring patterns. Additionally, bracket 4 could take the form of any of the brackets shown in FIGS. 17 through 30 (e.g., welded, bolted, drilled and tapped and screwed, or glued).

Figure 31:
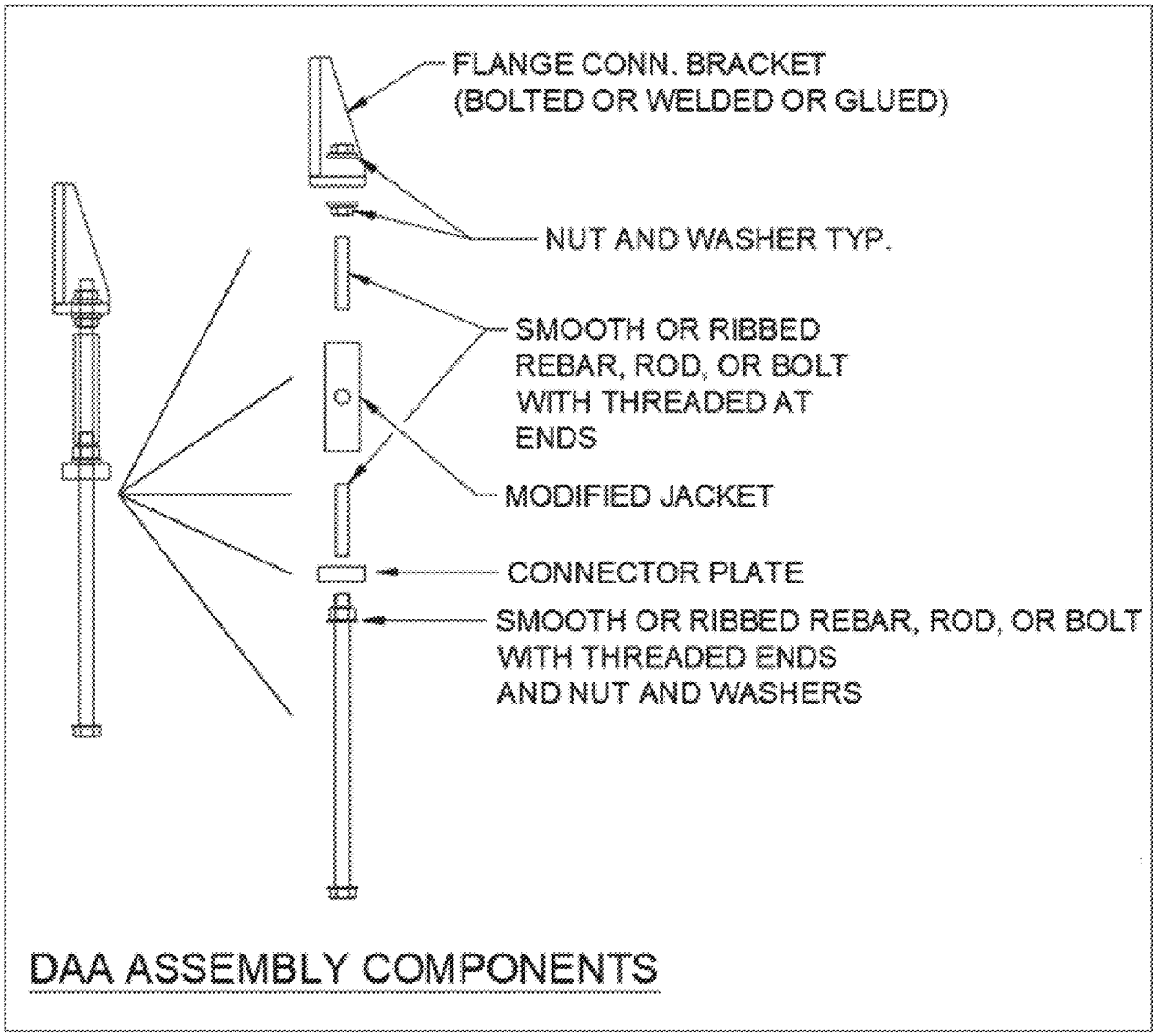
FIG. 31 and FIG. 32 illustrate an unmodified column/supporting member coupled with a modified DAA jacket, in which the jacket acts as both the jacket and the fuse.
Figure 32:
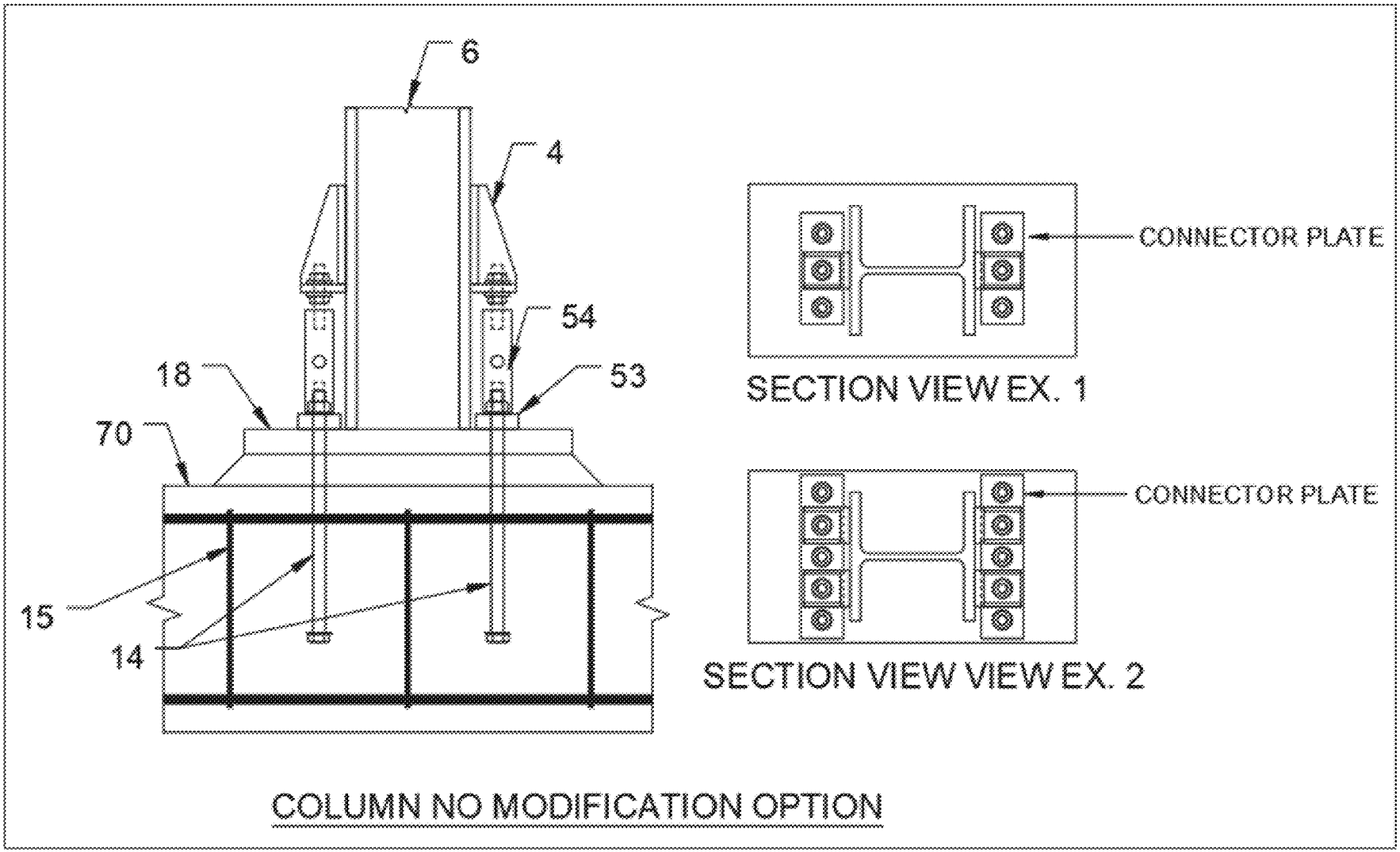

FIG. 31 and FIG. 32 illustrate an unmodified column/supporting member 6 coupled with a modified DAA jacket 54, in which the jacket acts as both the jacket and the fuse. By modifying the jacket by drilling a hole, other shape, or removing material, a stress concentration can be created that promotes controlled yielding of the material in tension and compression. Buckling is mitigated based on sizing of the jacket around the modification and extending the smooth or ribbed rebar, rod, or bolt with threaded ends into the jacket on either side of the jacket 54. The smooth or ribbed rebar, threaded rod, or bolt in turn are connected to the bracket 4 or connector plate 53 via bolting, welding, gluing, or drilling and tapping a hole for a threaded rod. This approach allows one to reduce the slenderness ratio to help prevent buckling along the length of the modified DAA 54. Using a connector plate 53, the system will help prevent plastic strain, stress, or deformation from entering the column/supporting member 6 with the DAA 54 dissipating most of the energy through controlled tension and compression yielding. It should also be observed, that by not directly connecting to the anchors 14, but rather connecting via a connector plate 53 resting on the base plate 18 freely (i.e., not positively attached to the base plate 18), damage to the anchors 14 can be avoided, thus avoiding costly repairs or replacement of the anchors embedded in the concrete foundation 70 reinforced with rebar 15. This design could also be used in conjunction with beams and braces like those described in FIG. 12, FIG. 17, FIGS. 22 through 24, and FIG. 28. It should be observed that the modified DAA jacket 54 could be welded or glued or threaded (via a drilled and tapped hole) directly to a bracket 4 or connector plate 53 without the use of smooth or ribbed rebar, rod, or bolt with threaded ends like element 27 shown in FIG. 21. In this circumstance, the system can still function, as described above, and can be replaceable. It should also be observed that the bracket 4 can be attached to either the flange, web, or any portion of a column/supporting member 6 for different anchoring patterns. Additionally, bracket 4 could take the form of any of the brackets listed in FIGS. 17 through 30 (e.g., welded, bolted, drilled and tapped and screwed, or glued).

Figure 33:
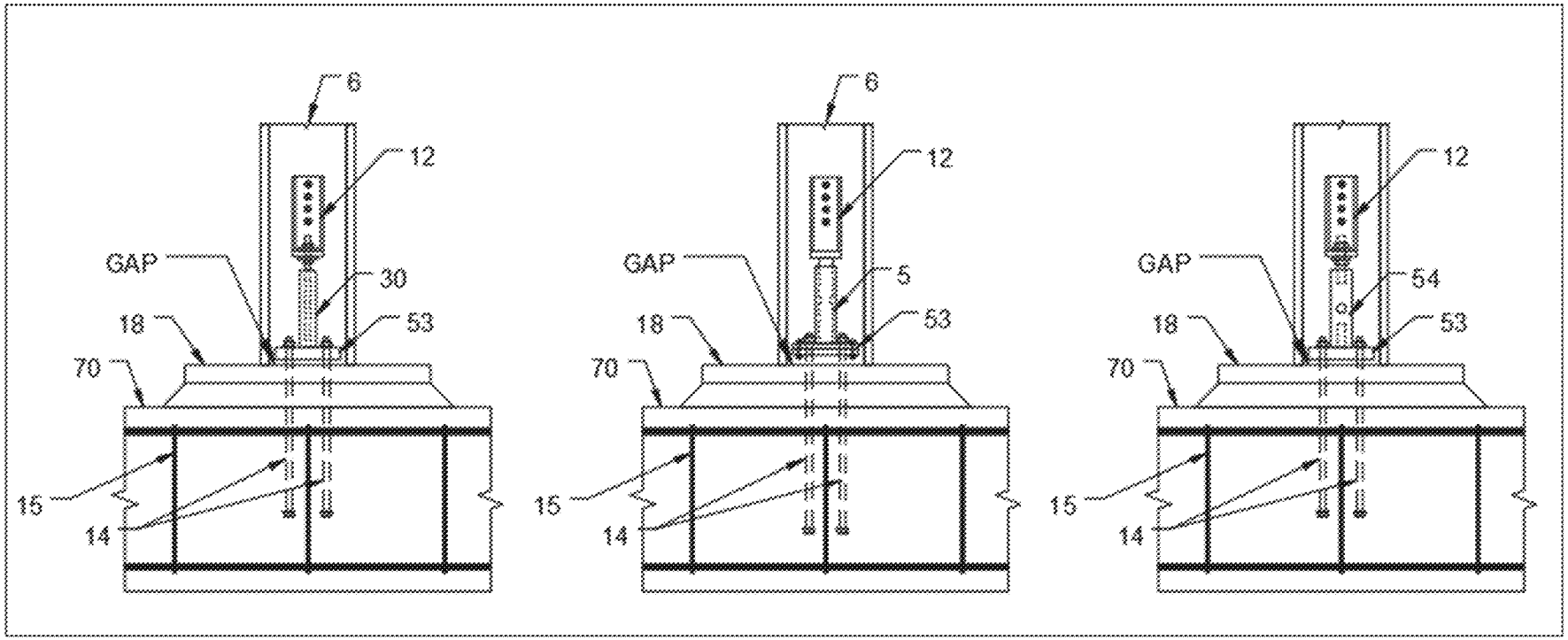
FIG. 33 illustrates various unmodified column/supporting member versions of the DAA in the example embodiments as disclosed herein.

FIG. 33 illustrates various unmodified column/supporting member 6 versions of the DAA 30, 5, and 54, which in terms of performance and behavior is identical to the descriptions provided for FIG. 18, FIGS. 29 and 30, and FIGS. 30 and 31. This figure illustrates how the DAA, fuse plates, or modified jackets, in their various embodiments shown and not shown, can be utilized for a column/supporting member 6 that is in tension, connected via to the web, or flange, or plate of a supporting member. Compressive forces can also be resisted by placing a pair of washers and nuts on either side of the connector plate 53 attached to the embedded anchors 14. However, it should be observed, that the column/supporting member 6, which is connected to element 18, will also resist compressive forces, thus making washers and nuts on either side of the connector plate 53 optional. For the arrangement shown, which, depending on the anchorage layout, may or may not be mirrored about the centerline of the web, preserves the column/supporting member's base as a pin connection without imparting large amounts of fixity. This system is also replaceable following the formation of a ductile yielding mechanism.

It is important to observe that gap or low modulus material (i.e., rubber, wax, etc.) is needed to promote a ductile mechanism formation in the DAA or fuse plate assembly. Without this absent or flexible medium, the column/support member could be engaged causing unwanted load sharing to occur. Also worth noting, the connector plate 53 should not be positively connected to the elements 6 or 18 to help prevent load path sharing and promote replaceability. Connection of the DAA 30, fuse plate 5, or modified jacket 54, to the bracket 12 and connector plate 53 can be accomplished via bolting, welding, gluing, or drilling and tapping a hole for a threaded rod or screw. The connector plate 53 can be composed of a single plate, multiple plates welded, multiple plates glued, or multiple plates bolted to one another via through bolts or tapped holes. Bracket 12 could take the form of any of the brackets shown in FIGS. 17 through 32, (e.g., welded, bolted, drilled and tapped and screwed, or glued). Also, the system shown in FIG. 33 can be modified to accommodate various DAA's, fuse plates, or modified jackets as described herein.

Figure 34:
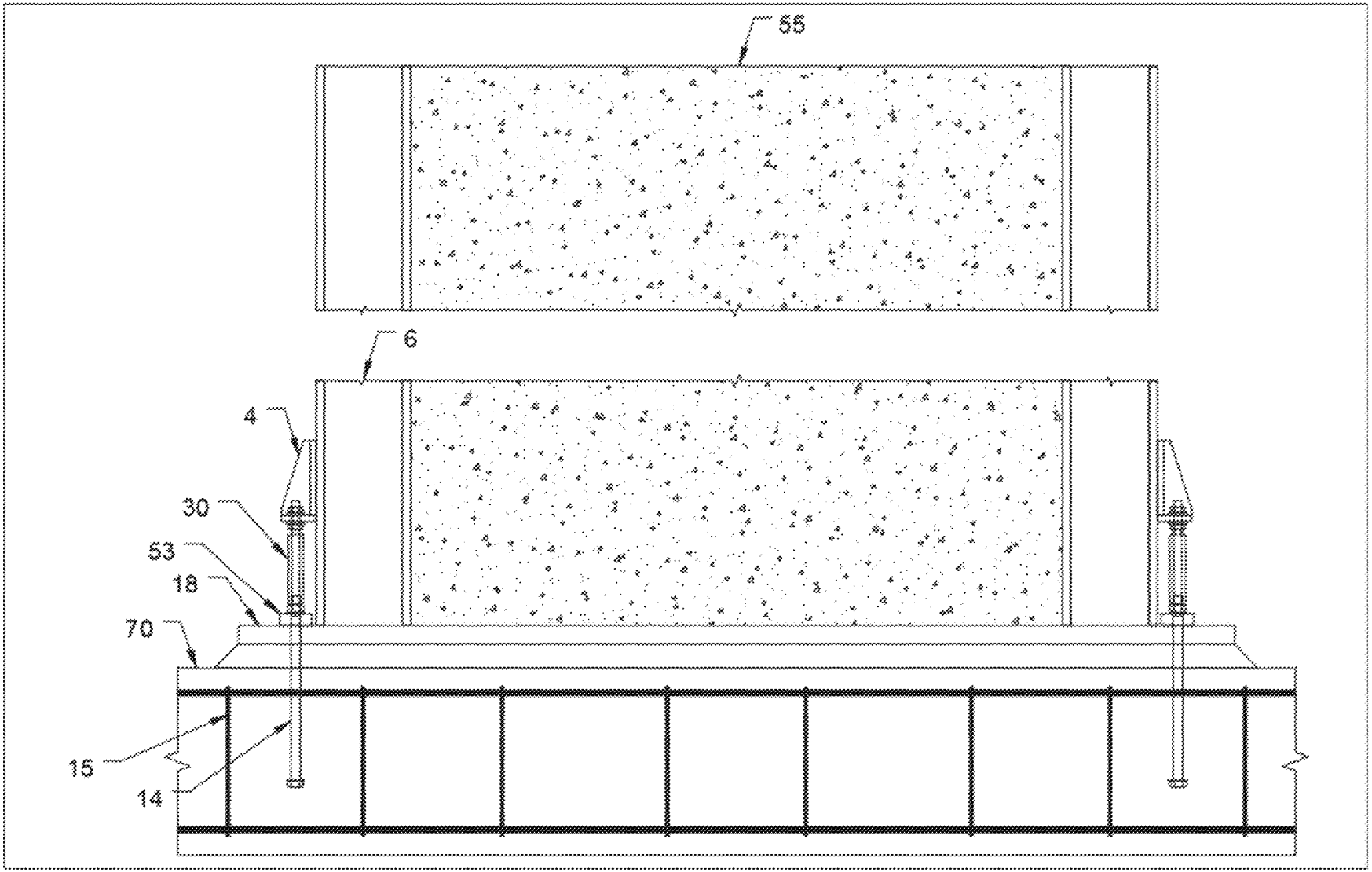
FIG. 34 and FIG. 35 illustrate how a DAA can be used in conjunction with a concrete, masonry, wood, steel, composite steel and concrete, composite steel and masonry, composite steel and wood, or 3D printed composite reinforced polymer shear wall.
Figure 35:
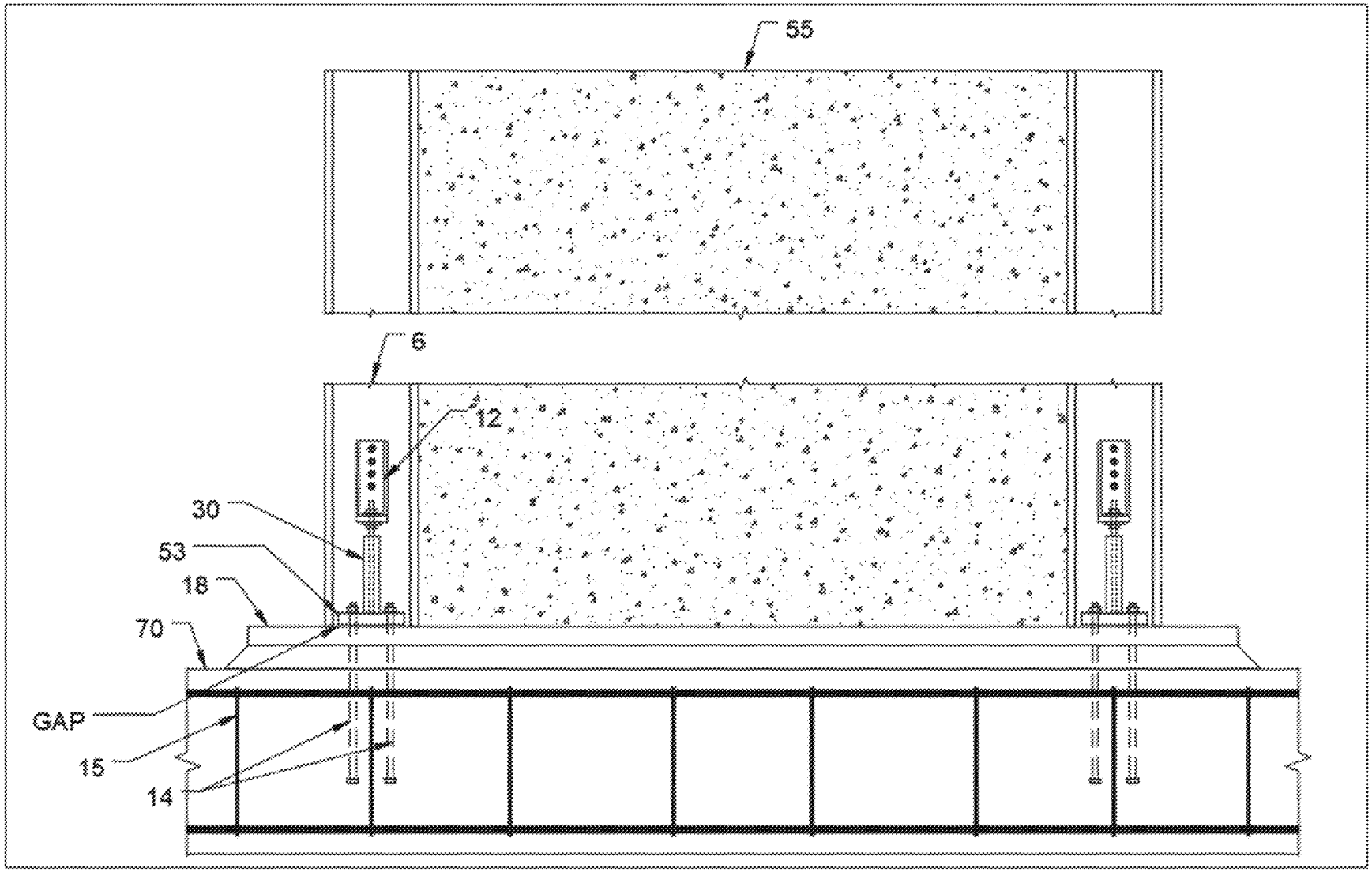

FIGS. 34 and 35 illustrate how a DAA 30 can be used in conjunction with a concrete, masonry, wood, steel, composite steel and concrete, composite steel and masonry, composite steel and wood, or 3D printed composite reinforced polymer shear wall 55. The shear wall 55 is connected positively to the foundation 70 with or without either a base plate 18 or column/supporting members 6. Various embodiments of the DAA 30 or fuse plate assemblies function as a tiedown/hold-down for the shear wall system. The behavior and performance of the DAA 30 or various fuse plate assembly embodiments function in a similar manner as described herein. Brackets 4 or 12 could take the form of any of the brackets shown in FIG. 8, (4, 8, 9, 10, 11, 12, or 13)(e.g., welded, bolted, drilled and tapped and screwed, or glued). It should be observed that the various embodiments of the DAA's, fuse plates, or modified jackets can be attached directly to the shear wall, along its length or at its ends using a variety of attachments. Depending on the material of the shear wall, the attachments may include but are not limited to embedded anchors, embedded plates, screws, bolts, weld, glue, and or drilled and tapped holes. Brackets 4 or 12 could take the form of any of the brackets shown in FIGS. 17 through 32, (e.g., welded, bolted, drilled and tapped and screwed, or glued). Also, the system shown in FIGS. 34 and 35 can be modified to accommodate different embodiments of DAA's, fuse plates, or modified jackets as described herein.

Figure 36:
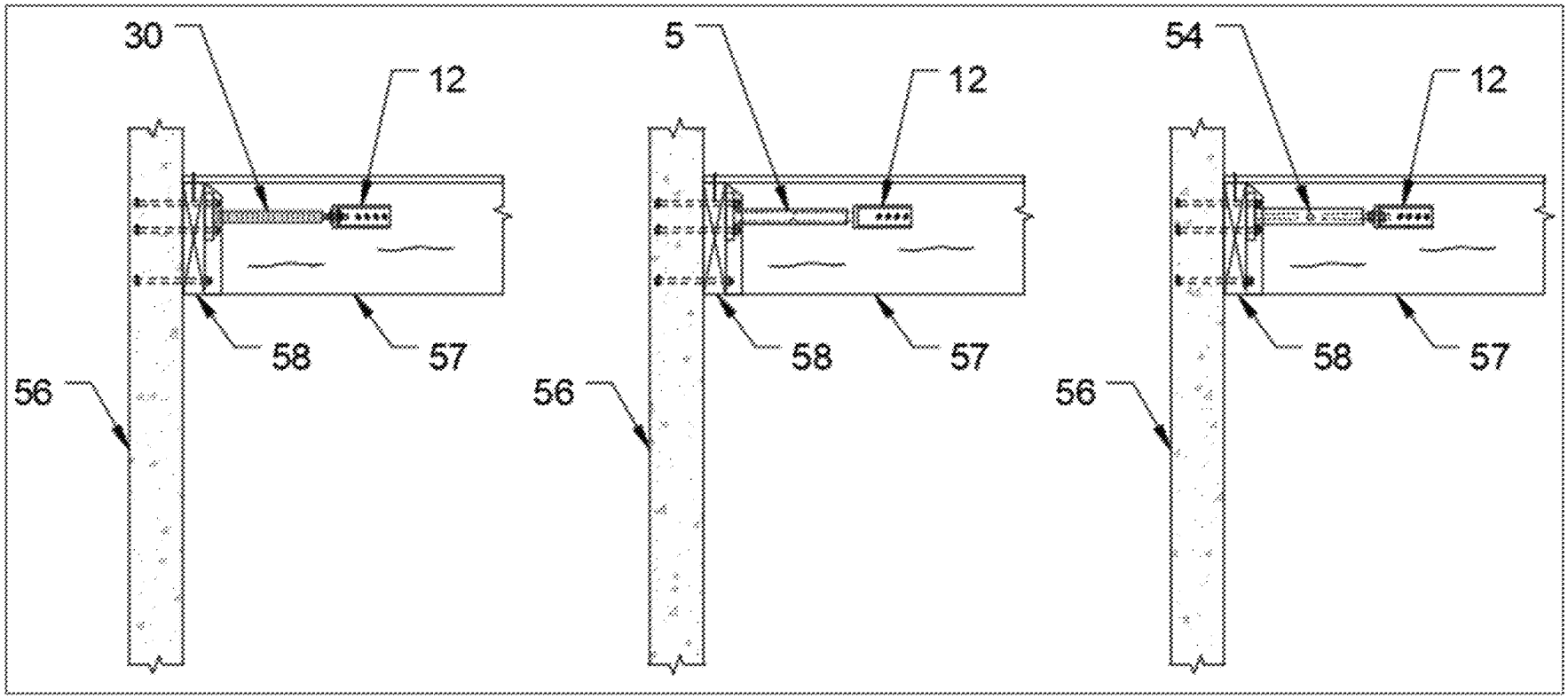
FIG. 36 illustrates how a DAA, fuse plate, and modified jacket can be used in conjunction with a wood or metal/steel joist, a wood or metal/steel ledger, or a concrete or masonry wall to transfer lateral forces directly into diaphragm framing.

FIG. 36 illustrates how a DAA 30, fuse plate 5, and modified jacket 54 can be used in conjunction with a wood or metal/steel joist 57, a wood or metal/steel ledger 58, or a concrete or masonry wall 56 to transfer lateral forces directly into diaphragm framing. The systems are primarily designed for tension forces, but if needed can also withstand compressive forces and be replaced following a ductile yield mechanism. The systems are similar in behavior and performance as those described in FIGS. 33, 34, and 35, with the beam 57 to ledger 58 hanger connection providing the flexible medium. It should be observed that other configurations of the DAA, fuse plates, or modified jacket disclosed herein can be used.

Figure 37:
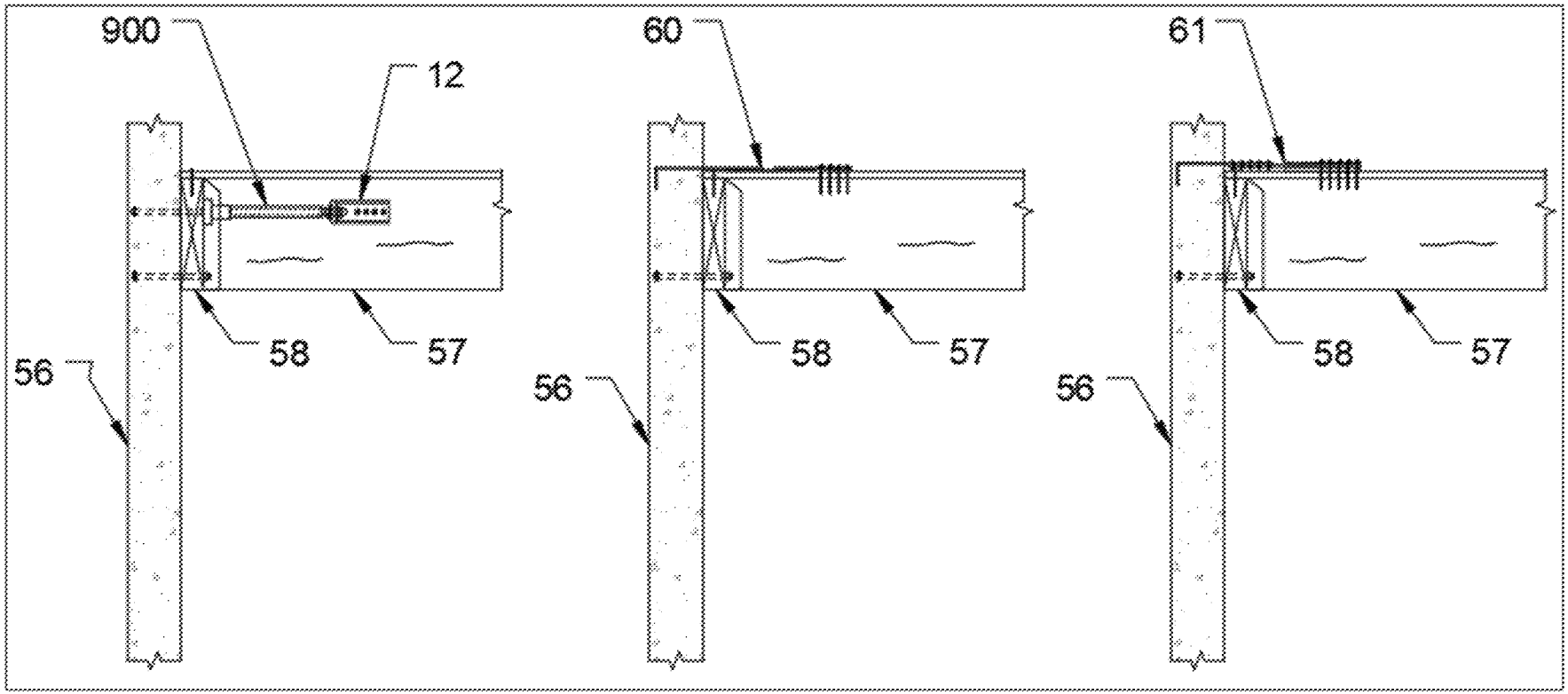
FIG. 37 and FIG. 38 illustrate other variations of anchor coupling as demonstrated by the example embodiments of the DAA and fuse plate assemblies disclosed herein.
Figure 38:
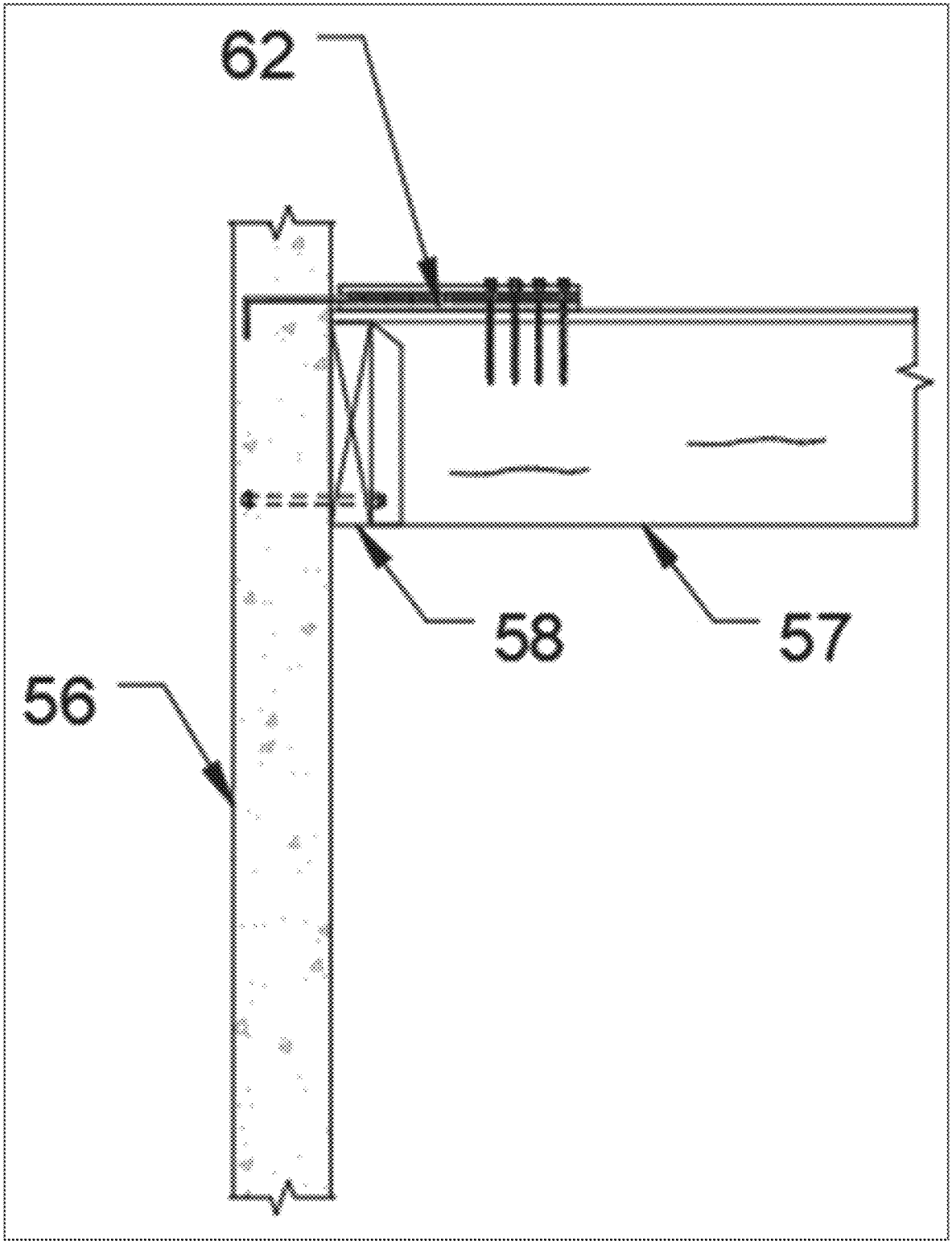
Figure 39:
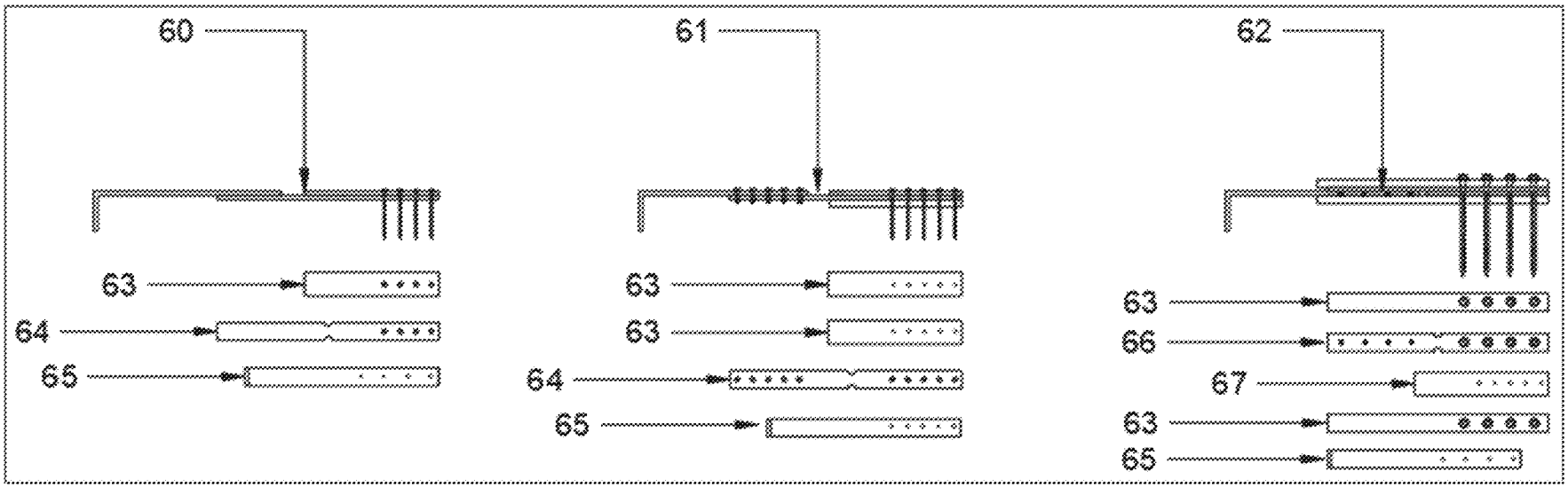
FIG. 39 illustrates various versions of the fuse plate assembly and related components in the example embodiments as disclosed herein.

FIGS. 37 and 38 illustrate other variations of anchor coupling as demonstrated by example embodiments of the DAA 900 and fuse plate assemblies 60, 61, and 62 disclosed herein. Regarding DAA 900, the DAA is identical in terms of performance and description as shown and described for FIGS. 9 through 14. The fuse plate assemblies 60, 61, and 62 showcase how a fuse plate can connect/couple to a strap made from metal/steel, composite, or 3D printed composite material. For the fuse plate assembly 60, the components are shown and described for FIG. 39. The strap 65, made from composite or metal/steel is embedded into the wall and welded or glued to the fuse plate 64. The fuse plate 64, made from metal/steel, is attached to brace plate 63, made from wood, wood composite, metal/steel, composite, or 3D printed composite material, using lag screws, or nails that are embedded into the beam 57. Together the connection to the strap 65 and brace plate 63 provide bracing support to the fuse plate 64 to help prevent buckling from occurring. The system also allows the fuse plate 64, which in terms of modification is identical to element 3, to undergo a ductile yield mechanism in tension or compression, preserve the embedded strap, and be replaceable. For the fuse plate assembly 61, the components are also provided as shown in FIG. 39. The strap is embedded into the wall and bolted to the fuse plate 64. Above and below the fuse plate 64 are brace plates 63, which connect to the fuse plate 64 via lag screws or nails, which are embedded into the beam 57. By placing the brace plates 63 on either side of the fuse plate 64, this creates a sandwich bracing assembly, like those described and shown in FIG. 26, thus preventing a buckling failure mode from forming. It should be observed that the lag screws and or nails pass through the brace plates 63 and the fuse plate 64. Like all other embodiments disclosed herein, this configuration is replaceable and allows a ductile yield mechanism to form, thus preserving the embedded strap. For the fuse plate assembly 62, the components are also provided as shown in FIG. 39. The strap is embedded into the wall and attached to the fuse plate via shear studs, which are welded or glued to the fuse plate 66. The shear studs provide only bearing resistance and are unthreaded. The fuse plate 66, made from similar material as described for fuse plate 64, is sandwiched between two brace plates 63 and a spacer plate 67 made from wood, wood composites, metal/steel, composite, or 3D printed composite material, which connect to a beam via lag screws or nails that pass through both the brace plates and fuse plate 66. By placing the brace plates 63 on either side of the fuse plate 66 with a spacer plate 67, this creates a sandwich bracing assembly, like those described and shown in FIG. 26, thus preventing a buckling failure mode from forming. This system also allows a ductile yield mechanism to form and preserve the embedded strap. It should be overserved, that in lieu of welded shear studs, plug/puddle welding or gluing could be used to connect the strap 65 to the fuse plate 66. Bracket 12, described herein, could take the form of any of the brackets shown in FIGS. 17 through 32, (e.g., welded, bolted, drilled and tapped and screwed, or glued). It should be observed that the embodiments 30, 5, 54, and 900 attaching to the beam 57 on its side, may or may not be mirrored about the centerline of the beam 57. The fuse plate 64 may be modified in various ways, like those described and shown in FIG. 16, FIG. 20, and FIG. 21 to create a weakened zone to help initiate a ductile yield mechanism.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A ductile anchor attachment (DAA) system comprising:

a DAA fuse plate including:

a bottom section configured to connect to an existing anchor;

a tapered lower section;

a narrowed neck forming a ductile yield mechanism;

a tapered upper section; and a connection mechanism for direct removable coupling of the DAA fuse plate to a structure being anchored, the connection mechanism being in contact with the tapered upper section of the DAA fuse plate, the DAA fuse plate in combination with the connection mechanism being configured to not buckle under compression forces and to adjustably dissipate tension forces acting on the structure being anchored.

2. The DAA system of claim 1 wherein the narrowed neck is a plate or bar.

3. The DAA system of claim 1 wherein the DAA fuse plate is a cut-out.

4. The DAA system of claim 1 wherein the connection mechanism includes perpendicular surfaces to removably couple the DAA fuse plate to a supporting member of the structure being anchored.

5. The DAA system of claim 1 being configured to undergo a ductile yield while preserving the integrity of a remaining structural anchoring system to which the DAA fuse plate is attached.

6. The DAA system of claim 1 being configured to be conveniently replaced after a yield event without extensive repairs to an existing structural anchoring system to which the DAA fuse plate was attached.

7. The DAA system of claim 1 wherein the connection mechanism is a beam to supporting member moment connection.

8. The DAA system of claim 1 wherein the connection mechanism is a supporting member to foundation connection.

9. The DAA system of claim 1 wherein the connection mechanism is coupled to a brace or bracket.

10. The DAA system of claim 1 wherein the narrowed neck is a fuse rod.

11. The DAA system of claim 1 wherein the connection mechanism is coupled to a wide flange beam.

12. The DAA system of claim 1 wherein the DAA fuse plate is composed of a flat steel, composite, or three dimensional (3D) printed composite plate or bar.

13. The DAA system of claim 1 including a jacket encapsulating the narrowed neck.

14. The DAA system of claim 13 wherein the jacket is fabricated from steel, composite, or three dimensional (3D) printed composite material.

15. The DAA system of claim 13 wherein the jacket is composed of outer connecting plates that are welded, glued, drilled and tapped and screwed, or bolted together.

16. The DAA system of claim 1 wherein the DAA fuse plate is configured to be stacked for redundancy.

17. The DAA system of claim 1 wherein the connection mechanism is configured for coupling to a flange, web, or any portion of a supporting member.

18. The DAA system of claim 1 wherein the narrowed neck is jacketed via a sandwich plate assembly composed of two outer plates and a spacer plate.

19. The DAA system of claim 1 wherein the connection mechanism includes a connector plate resting freely on a base plate.

20. The DAA system of claim 13 wherein the jacket is weakened by removing material from the jacket to promote controlled yielding of the jacket in tension and compression.

* * * * *